US009248847B2

(12) United States Patent
Zona et al.

(10) Patent No.: US 9,248,847 B2
(45) Date of Patent: Feb. 2, 2016

(54) DOOR UNIT FOR RAIL VEHICLES

(75) Inventors: Mauro Zona, Turin (IT); Francesco Paolo Di Maio, Gragnano (IT)

(73) Assignees: Mauro Zona, Turin (IT); Francesco Paolo Di Maio, Gragnano (NA) (IT); Luigi Camellini, Castelnuovo Rangone (MO) (IT)

( * ) Notice: Subject to any disclaimer, the term of this patent is extended or adjusted under 35 U.S.C. 154(b) by 118 days.

(21) Appl. No.: 14/129,607

(22) PCT Filed: Jun. 19, 2012

(86) PCT No.: PCT/IB2012/053078

§ 371 (c)(1),
(2), (4) Date: Jan. 30, 2014

(87) PCT Pub. No.: WO2013/001409

PCT Pub. Date: Jan. 3, 2013

(65) Prior Publication Data

US 2014/0130705 A1 May 15, 2014

(30) Foreign Application Priority Data

Jun. 30, 2011 (IT) ..... TO2011A0579

(51) Int. Cl.

| | |
|---|---|
| ***B61D 19/00*** | (2006.01) |
| ***B61D 17/04*** | (2006.01) |
| ***B61D 17/08*** | (2006.01) |
| ***B61D 19/02*** | (2006.01) |

(52) U.S. Cl.

CPC ..... *B61D 19/005* (2013.01); *B61D 17/045* (2013.01); *B61D 17/08* (2013.01); *B61D 19/02* (2013.01)

(58) Field of Classification Search

CPC .... B61D 19/00; B61D 19/001; B61D 19/003; B61D 19/005; B61D 19/02; B61D 19/026

USPC ..... 105/238.1, 280, 282.1, 282.2, 282.3, 105/286–288, 396–398

See application file for complete search history.

(56) References Cited

U.S. PATENT DOCUMENTS 3,745,707 A * 7/1973 Herr ..... 49/449

FOREIGN PATENT DOCUMENTS

EP 0508036 * 10/1992 ..... B61D 17/20
EP 0508036 A1 10/1992

(Continued)

OTHER PUBLICATIONS

International Search Report for PCT/IB2012/053078 dated Aug. 16, 2012.

*Primary Examiner* — R. J. McCarry, Jr.
(74) *Attorney, Agent, or Firm* — Heslin Rothenberg Farley & Mesiti P.C.; Victor A. Cardona, Esq.

(57) ABSTRACT

A door unit for rail vehicles includes one or two sliding doors, means for supporting and guiding each sliding door between a closed position and an open position, and means for controlling the movement of each door between a closed position and an open position. The supporting, guiding and controlling means are carried on a support unit which defines an independent module with the doors, assembled prior to being mounted on the vehicle structure. The support unit includes at least one frame connectable to the vehicle structure and supporting each door, and the respective guiding and controlling means. The frame includes an upper cross-member, a lower cross-member and two uprights connecting these cross-members between them, in such a way to form a perimeter frame that defines a doorway, and which surrounds the four sides of the door or doors, when they are in the closed position.

14 Claims, 20 Drawing Sheets

(56) References Cited

FOREIGN PATENT DOCUMENTS

| | | | |
|---|---|---|---|
| EP | 1149750 | A2 | 10/2001 |
| EP | 1314626 | A1 | 5/2003 |
| EP | 1767389 | A2 | 3/2007 |
| JP | 2003081086 | A | 3/2003 |
| JP | 2005193803 | A | 7/2005 |
| WO | 0242105 | A1 | 5/2002 |

* cited by examiner

FIG. 5
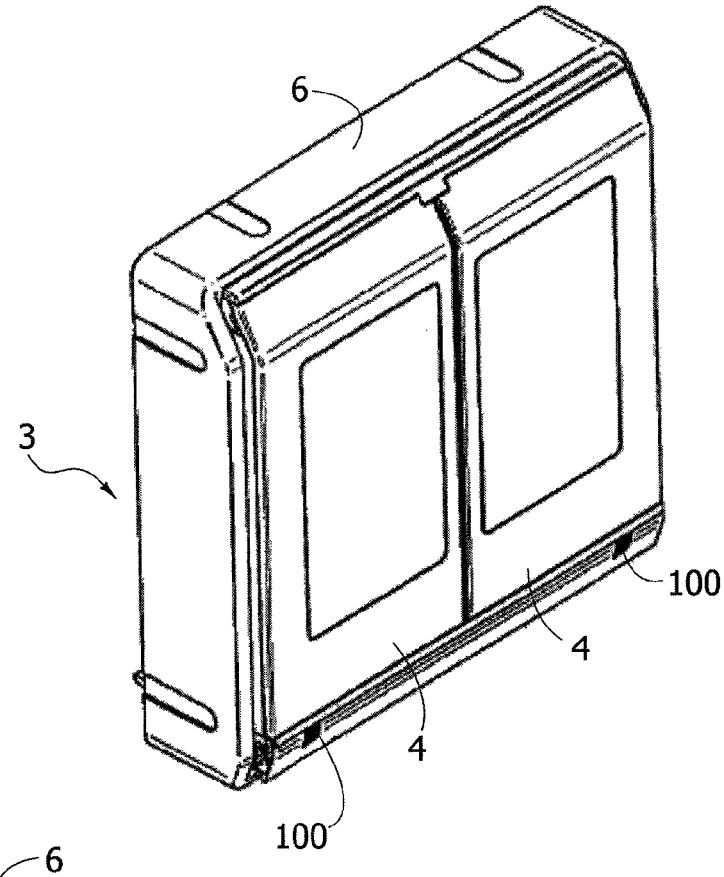
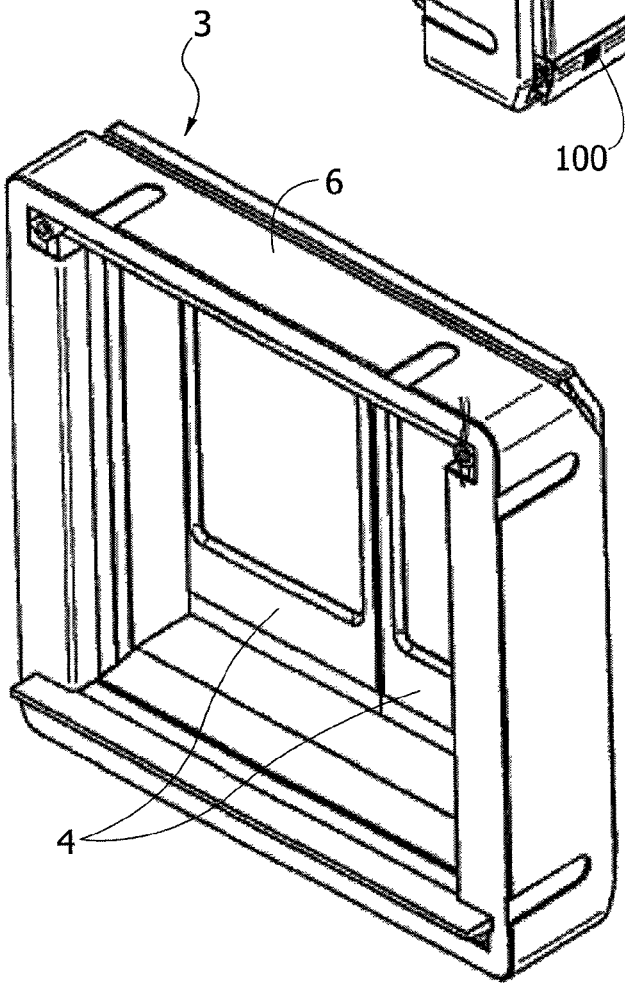
FIG. 6

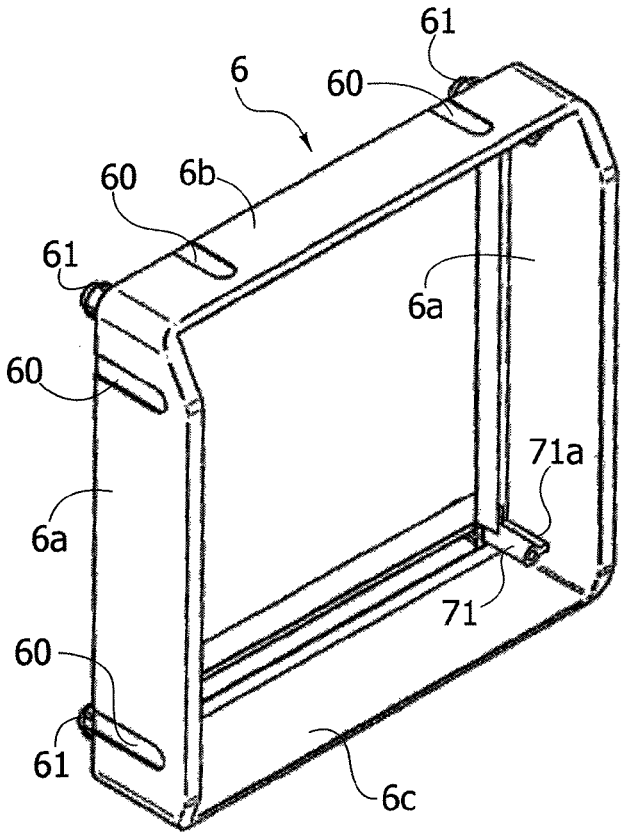
FIG. 9
FIG. 10
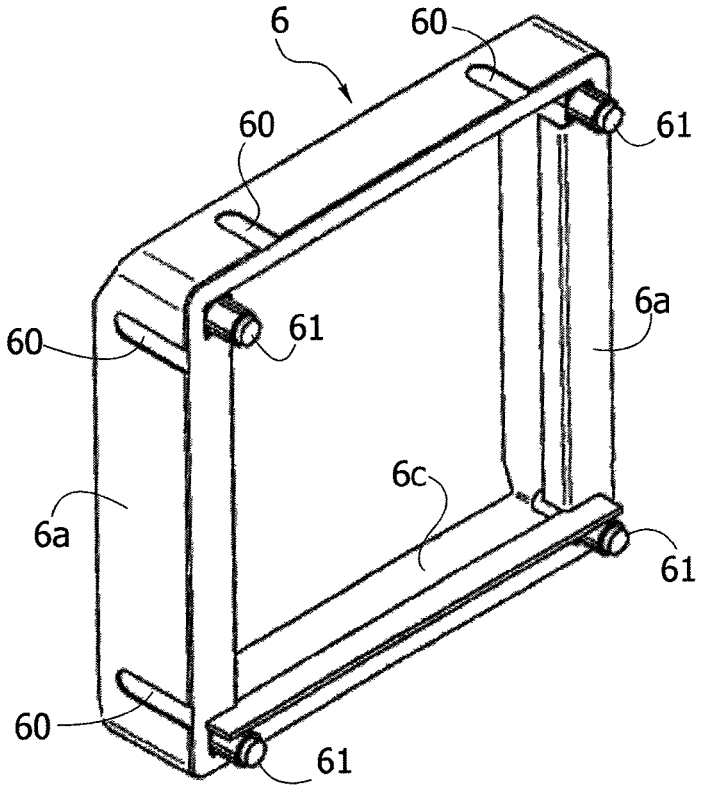

DOOR UNIT FOR RAIL VEHICLES

CROSS REFERENCE TO RELATED APPLICATIONS

This application is a 371 National Phase of PCT International Application No. PCT/IB2012/053078 filed on Jun. 19, 2012, and published in English as WO 2013/001409 A1 on Jan. 3, 2013, which claims priority to Italian Patent Application No. TO2011A000579 filed on Jun. 30, 2011, the entire disclosures of which are incorporated herein by reference.

FIELD OF INVENTION

The present invention relates to a door unit for rail vehicles, in particular for trains or subway trains of the type comprising:

at least one sliding door, means for supporting and guiding said at least one sliding door between a closed position and an open position, and means for controlling the movement of said at least one sliding door between a closed position and an open position.

The invention applies both to door units comprising a single sliding door, and door units comprised of a pair of sliding doors.

PRIOR ART

According to the conventional art, the means for supporting and guiding sliding doors are mounted, at least in part, on the structure of the vehicle. Furthermore, in its closed condition, each single door cooperates directly with parts of the vehicle structure in order to achieve tight closure. Consequently, the known solutions have the drawback of requiring long and laborious assembly operations of the doors. These operations must be performed directly on the vehicle, mounting a plurality of different components, separated between each other, and on-site adapting of this unit to the specific characteristics of the vehicle structure, which itself is subject to variations in the project configuration. All this makes it practically impossible to achieve the production and assembly of doors with the criteria of an industrial mass production, with consequent drawbacks, also with reference to production costs.

The documents WO 02/42105, EP 1 314 626 A1, EP 1 767 389 A2 and EP 0 508 036 A1 show door units of the type indicated above, wherein the means for supporting, guiding and controlling the doors are carried on a support unit which defines an independent module with said doors. However, in these known solutions the said door support unit is uniquely placed above the doors, whereby in the closed condition the doors cooperate directly with the vehicle structure along their vertical edges and their lower side to achieve tight closure. Therefore, even in the case of these known solutions it is necessary to perform long and laborious adjustment operations at the time of the door unit installation on the vehicle. In addition, the known solutions do not reliably guarantee that the doors do not become released from its relative means for guiding when they are subjected to high forces that push the doors towards the outside, for example due to the depression effect that occurs when the vehicle passes by another high-speed vehicle in a tunnel.

MAIN OBJECT OF THE INVENTION

The object of the present invention is to overcome said drawbacks of the prior art, producing a door unit that is able to be completely assembled separately and then quickly installable on the vehicle, without the need for any subsequent adjustment operations.

SUMMARY OF THE INVENTION

In view of achieving this object, the invention relates to a door unit for rail vehicles, characterized in that said support unit includes at least one frame connectable to the vehicle structure and carrying said at least one door, and the respective means for guiding and controlling, in that said at least one frame includes an upper cross-member, a lower cross-member and two uprights connecting these cross-members between them, in such a way as to form a perimeter frame that defines a doorway, which surrounds the four sides of said at least one door when it is in a closed position, and in that in said closed position said at least one door only cooperates only with parts of said at least one perimeter frame to achieve closure of the doorway.

MAIN ADVANTAGES OF THE INVENTION

Due to this feature, the door unit according to the invention constitutes a module which can be mounted on the vehicle structure by means of a single, simple operation, after being assembled and tested by the door manufacturer, with the criteria of an industrial production. Analogous advantages occur when a replacement procedure of the door unit is necessary, with a view to its repair. The replacement operation is fast and easy, since as mentioned, no adjustment, regulation or calibration operations of the door are necessary following installation on the vehicle, since whatever position the door is in, it only cooperates with support unit parts and not with the vehicle parts. The vehicle does not have to be left out-of-service and the broken-down door unit can be re-installed in an equally easy and fast manner once the repair has been carried out.

The rigid connection of the unit on the vehicle structure can naturally be created in any known way, but the preferred solution is that of a removable connection, by means of bolts, which gives rise to obvious advantages from the point of view of the ease and efficiency of replacement and maintenance operations.

The invention results in a reduction in the time of production and development of the whole vehicle, in that the assembly activities of the vehicle and assembly of the door unit can proceed independently. As said, it should also be noted that the maintenance of the door unit can be carried out so that the time that the train is non-operational is minimized, as the broken-down door units can be replaced in a short time with a functional unit, and repaired separately. This aspect is crucial, for example on driverless subway trains as they operate around-the-clock, seven days a week.

According to a further preferred feature of the invention, the means for guiding the movement of each door, carried by said support unit comprise at least one upper sliding guide which guides the upper part of the door on the upper cross-member of the perimeter frame, and at least one lower sliding guide that guides the lower part of the door on the lower cross-member of the perimeter frame.

Preferably, the upper and the lower part of the door are each provided with two sliding guides which are parallel and spaced, including, respectively, a first guide that comprises a rail carried by the perimeter frame, and at least one sliding block carried by the door, and slidable on the rail, and a second guide which includes a rail carried by the door, and at least one sliding block carried by the perimeter frame, and slidable on the rail.

Thanks to said characteristics, the movement of opening and closing of each door is guided in an absolutely strict and precise manner, which again eliminates the need for adjustment or regulation operations after the door has been installed on the vehicle, since the door only cooperates with the perimeter frame of the unit, so that all said operations can be performed prior to mounting the unit on the vehicle.

ADDITIONAL ADVANTAGES OF PREFERRED EMBODIMENTS OF THE INVENTION

In the most simplified embodiment of the present invention, the door unit comprises a single perimeter frame. However, preferably, the unit of the invention is made with one or two additional perimeter frames supported in succession from one another, and movable horizontally and vertically, as will be specified below, in order to also solve the problem of the horizontal gap and the vertical gap existing between the edge of the vehicle floor and the station platform when the vehicle is stationary in the station and the doors are open to allow boarding and alighting of passengers.

A first additional object of the invention is to minimize or completely eliminate the horizontal gap. In the prior art, this problem is generally solved with the predisposition of footrests that extend across the vehicle floor when it is stationary in stations and the doors are open. In the case of the invention, to this end, the door unit comprises, in a simpler embodiment, a first perimeter frame, rigidly connected to the vehicle structure and a second perimeter frame supporting said means for supporting and guiding the door and said means for controlling the door, the second perimeter frame being supported by said first frame so as to be displaceable with respect to it in a horizontal direction orthogonal to the general plane of the door, between a retracted position and an advanced position with respect to the side of the vehicle, in order to reduce or eliminate any gap in the horizontal direction between the vehicle floor and the station platform, said unit further comprising actuating means carried by said first frame, to control the horizontal movement of said second frame with respect to said first frame between the retracted position and the advanced position.

In the case where it is also desired that the problem of a possible gap in the vertical direction between the edge of the vehicle floor and the station platform is resolved, the invention is realized in a more complex form, wherein the unit comprises a first perimeter frame, rigidly connectable to the vehicle structure, a second perimeter frame supported by said first frame so as to be displaceable with respect to it in a horizontal direction, orthogonal to the general plane of the door, between a refracted position and an advanced position with respect to the side of the vehicle, in order to reduce or eliminate any gap in the horizontal direction between the vehicle floor and the station platform, said unit further comprising actuating means carried by said first frame, to control the horizontal movement of said second frame with respect to said first frame, between the retracted position and the advanced position, and a third frame, carrying said means for supporting and guiding said at least one door and said means for controlling said at least one door, said third frame being supported by said second frame and being movable with respect to it in a vertical direction, in order to reduce or eliminate any difference in height between the vehicle floor and the station platform, and actuating means carried by said second frame, to control the vertical movement of said third frame with respect to said second frame.

Preferably, said support unit is provided with sensor means for detecting the distance of the door unit from a station platform when the vehicle is stationary at a station, and electronic control means adapted to receive output signals from said sensor means and to generate a signal alarm when the distance detected is not contained within a predetermined range, or to control the actuator means which control the horizontal movement of the second frame, and the actuating means which control the vertical movement of the third frame in order to automatically reduce or eliminate the gap in the horizontal direction and the gap in the vertical direction between the vehicle floor and the platform when the vehicle is stationary at a station, so as to provide an automatic adaptation of the door unit to the actual distance from a station platform.

The proposed system is also equipped with a security sensor subsystem to detect obstacles in the path of closing doors. Said sensors are in dual configuration for each control function provided. The door unit is able to signal the non-correct functionality of the single sensor, in this way a maintenance call is activated without preventing the proper functioning of the door unit. The proposed system is also equipped with sensors, again in a dual configuration, to detect situations wherein the distances between the doors and the platform are smaller than those offsettable with the movements of the door unit in order to allow the door unit to specifically adapt itself. For this feature as well, the approach of the detection/maintenance of the fault of the individual sensor is adopted as described above.

The system in question also allows the memorization of the distance from the platform of the door unit in the closed condition, for statistical purposes and for predictive maintenance.

In view of the above, it is evident that the door unit according to the invention is able to solve, in a simple and efficient manner, a series of drawbacks related to the known solutions, both with reference to the production, assembly and maintenance of the doors, and with reference to the elimination of the gap between the vehicle and the platform when the vehicle is stationary at a station, both with reference to the simplification of the drive transmission of the movement of the door between a closed position and an open position, and finally to the stability and reliability of the guiding of the door movement, as well as to the safety of the resistance of the door-vehicle connection even in the case of strong depression effects outside the vehicle.

Other advantageous features of the invention are indicated in the accompanying dependent claims.

BRIEF DESCRIPTION OF THE DRAWINGS

Further characteristics and advantages of the invention emerge from the description which follows with reference to the accompanying drawings, provided purely by way of a non-limiting example, wherein:

FIGS. 5, 6 show two perspective views of the unit according to the invention, from the front and from behind, in a travelling condition, with closed sliding doors and frames in their refracted position, FIGS. 9, 10 are a front perspective view and a rear perspective view of only the first frame that is part of the unit according to the invention.

DESCRIPTION OF SOME PREFERRED EMBODIMENTS

Figure 1:
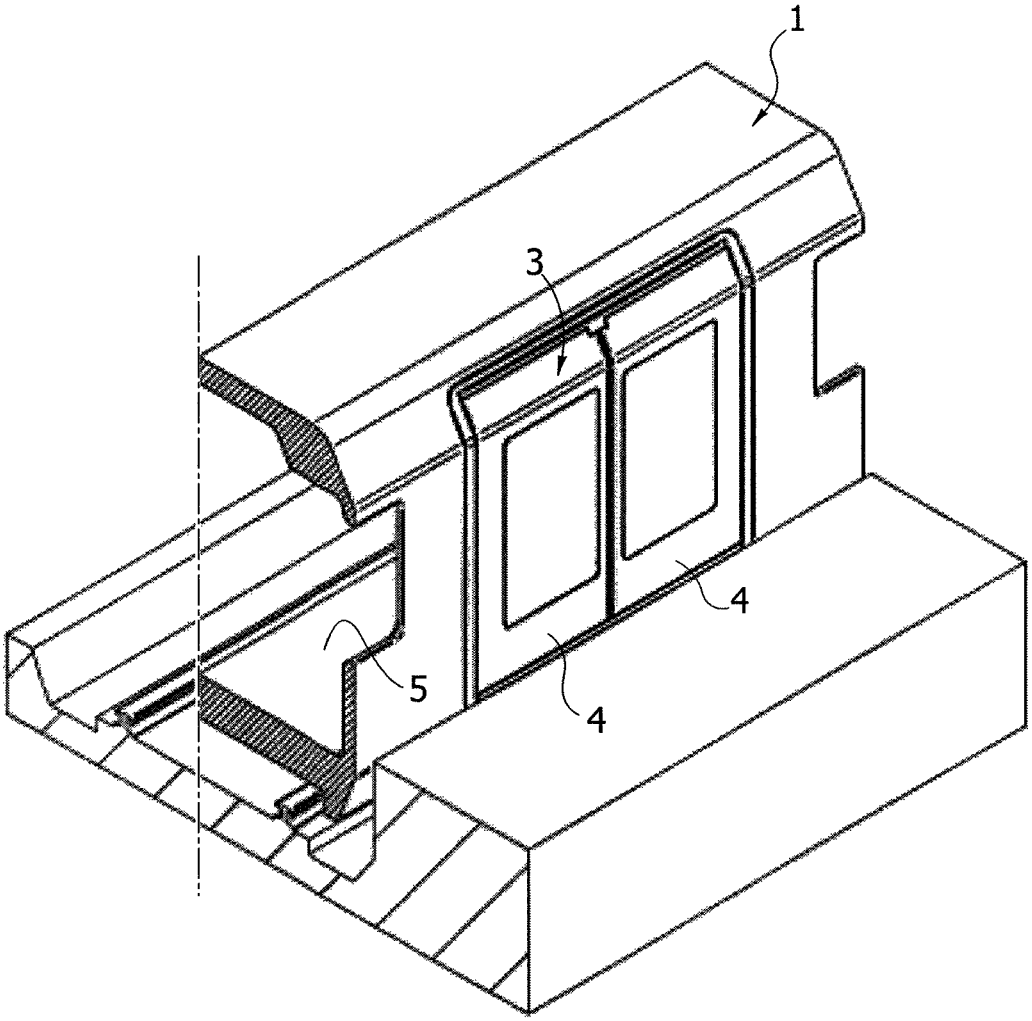
FIG. 1 is a partial perspective and sectional view of a subway carriage illustrated as being stationary at a station, close to the platform, and provided with a door unit according to one preferred embodiment of the invention.
Figure 2:
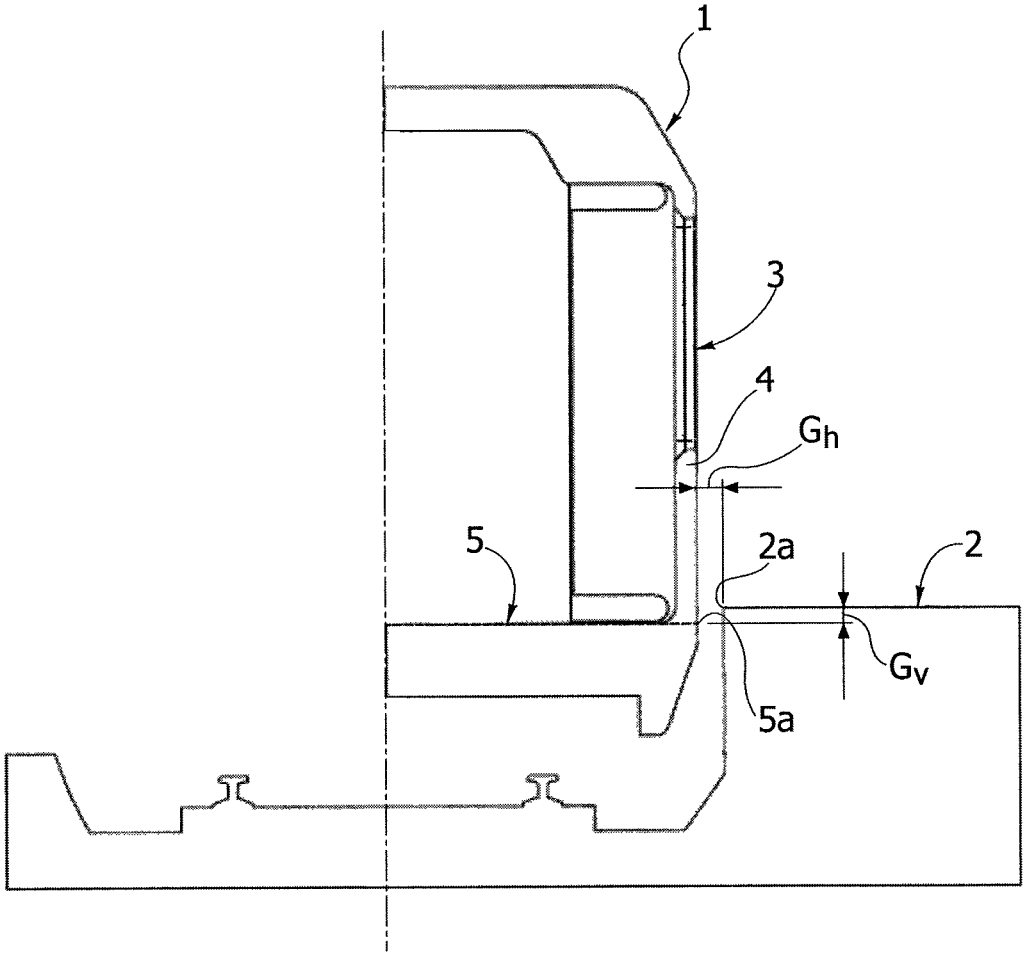
FIG. 2 is a schematic sectional view of the vehicle of FIG. 1.

FIGS. 1 and 2 of the accompanying drawings illustrate a schematic perspective view and a partial cross-sectional view of a subway carriage 1 stationary at the station, adjacent to a platform 2, provided with a door unit 3 in a preferred embodiment of the invention.

As explained at the beginning of this description, the invention applies to any rail vehicle, and in particular both to trains and subway trains. As well as that already indicated at the beginning of this description, the door unit of the invention may be realized both with two doors, and with a single door.

FIGS. 1-25 of the accompanying drawings relate to a door unit for subway trains, comprising two sliding doors, movable between a close-range closed position and a distanced open position. The specific example refers to the case of a subway carriage of the "driverless" type.

FIGS. 26-30 relate to a door unit for trains, in particular high-speed trains, comprising a single sliding door.

With reference initially to FIGS. 1, 2, the carriage 1 is equipped with a door unit 3 comprising two sliding doors 4. In the open condition of the doors 4 it is possible to move passengers between the platform 2 and the floor 5 inside the carriage 1. As shown in FIG. 2, the typical condition that occurs is that wherein the edge 2*a* of the platform 2 and the edge 5*a* of the floor 5 are spaced apart by a length $G_h$ in the horizontal direction, and a length $G_v$ in the vertical direction. The value of these distances is variable, and dependent on the movements of the vehicle structure on its suspension, e.g. as a result of the movements of passengers within the vehicle. For example, the gap $G_h$ can reach values in the order of 100 mm, while the vertical position of the edge 5*a* with respect to the edge 2*a* can vary between −20 mm and +40 mm.

Figure 3:
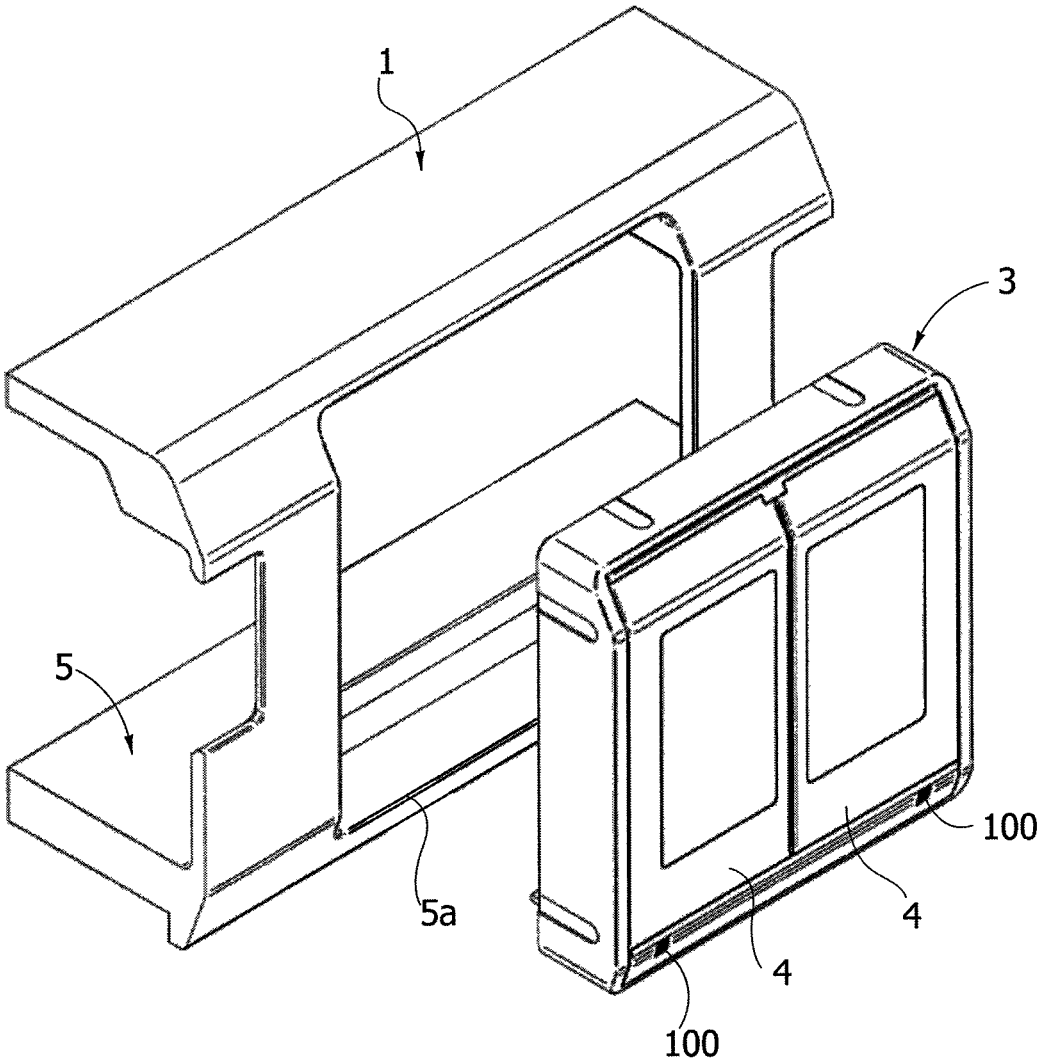
FIG. 3 is an exploded perspective view showing the door unit according to the invention in a disassembled condition with respect to the vehicle structure.

FIG. 3 shows unit 3 of the invention separated and spaced from the vehicle structure 1. Unit 3 carries the sliding doors 4 and constitutes, according to the fundamental idea underlying the invention, an independent module, incorporating the doors 4 and the means for supporting and guiding such doors in their movement between a closed position and an open position, as well as the means for controlling said movement, and the fixed parts which cooperate with the doors in the closed position in order to tightly close the compartment door.

Figure 4:
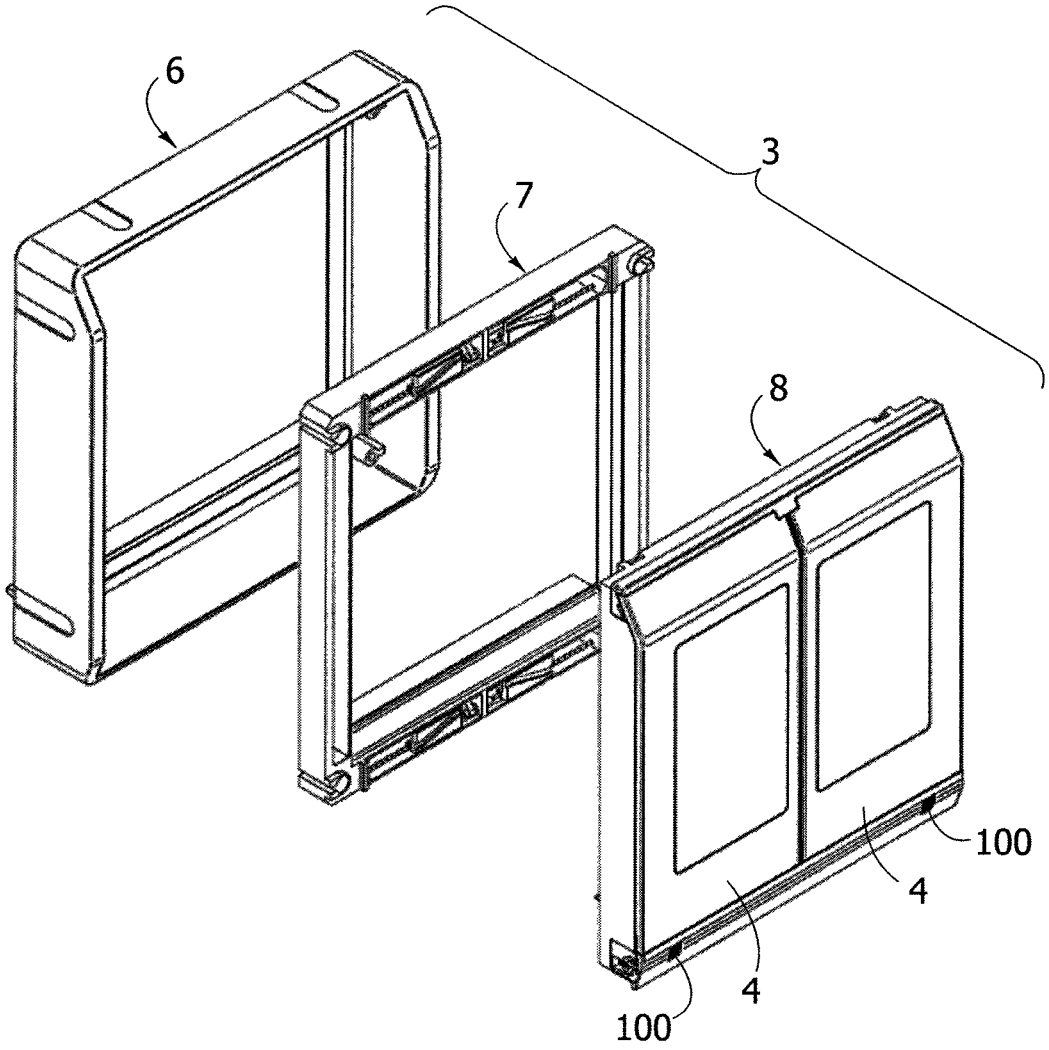
FIG. 4 is a further exploded perspective view of the unit according to the invention, including a first frame for the rigid connection to the vehicle structure, a second frame movable horizontally with respect to the first frame, and a third frame carrying the two sliding doors, and movable vertically with respect to the second frame.

According to the general architecture visible in the exploded view shown in FIG. 4, unit 3 includes a first perimeter frame 6 which is intended to be rigidly connected to the vehicle structure 1, for example by means of bolts (not shown). The unit also includes a second perimeter frame 7 carried by the first frame 6 and movable with respect to it in a horizontal direction transverse to the longitudinal direction of the vehicle, between a retracted potion and an advanced position, protruding towards the outside of the vehicle. The unit finally comprises a third perimeter frame 8 carried by the second frame 7 and carrying the sliding doors 4. The third frame 8 is movable relative to the second frame 7 in the vertical direction. The three frames define the outer doorway for the passengers when the doors are open.

Figure 7:
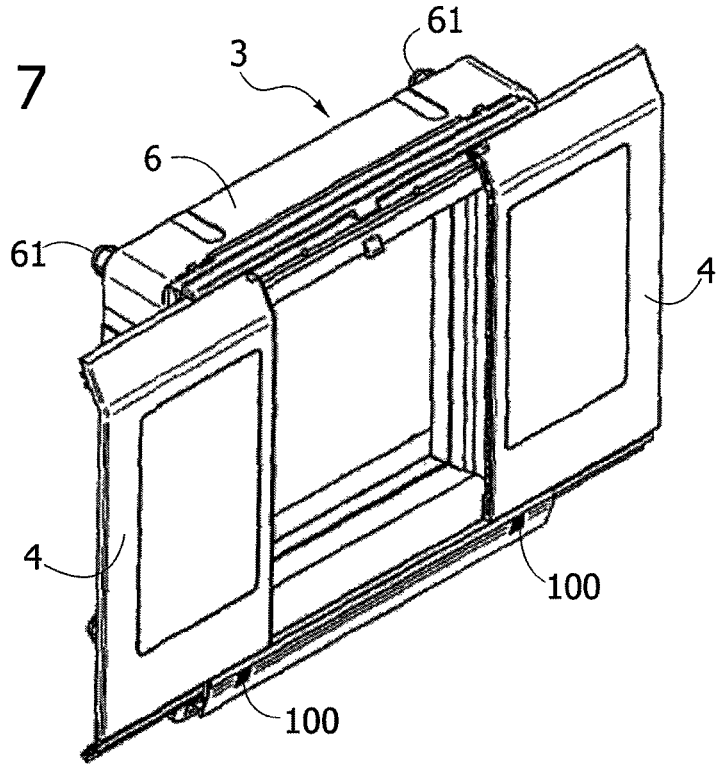
FIGS. 7, 8 show two perspective views of the unit according to the invention in the open door condition and frames in the advanced position.
Figure 8:
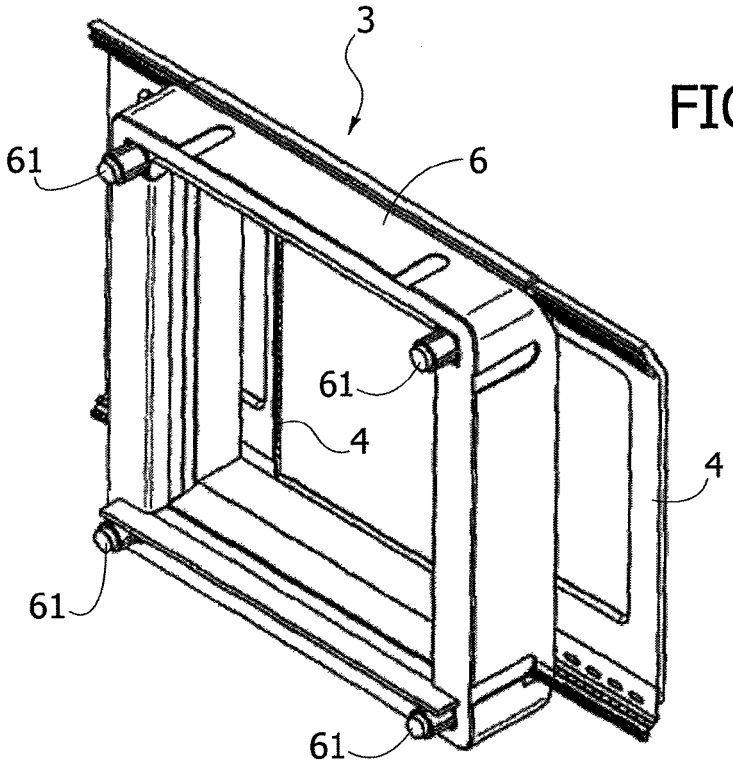

FIGS. 5, 6 show the unit in the closed door condition, with the second frame 7 in its retracted position and the third frame 8 in its lowered position. FIGS. 7, 8 show the same unit 3 with the doors 4 open, the third frame 8 in a raised position and the second frame 7 in the advanced position.

The specific structure of each of frames 6, 7, 8 and the means for controlling the horizontal movement of the second frame 7, for controlling the vertical movement of the third frame 8 and for supporting and guiding the movement of the sliding doors 4 are described in detail here below.

As shown in FIGS. 9, 10, the first perimeter frame 6 comprises a structure with two vertical side walls 6*a*, an upper cross-member 6*b* and a lower cross-member 6*c* which connect the ends of the vertical walls between them. Frame 6 has grooves 60 on its outer peripheral surface for driving the corresponding engaging elements provided on the vehicle structure, in order to ensure the assembly of frame 6 in the correct position. Rigid connection to the vehicle structure is carried out, for example, by means of bolts (not shown in the drawings). Again in the case of the example illustrated, four electric motors 61 are posteriorly associated to frame 6 and adjacent to the four corners of the frame, designed to control the horizontal movement of the second frame 7 with respect to the first frame 6. Each of the motors 61 rotationally controls a screw which engages in a nut carried by the second frame 7 so as to be locked in rotation, whereby the activation of the motors 61 and the consequent rotation of the screws controlled by the motors causes an axial displacement of the nuts (one of which has been illustrated in FIG. 9 and indicated by the reference numeral 71).

Figure 11:
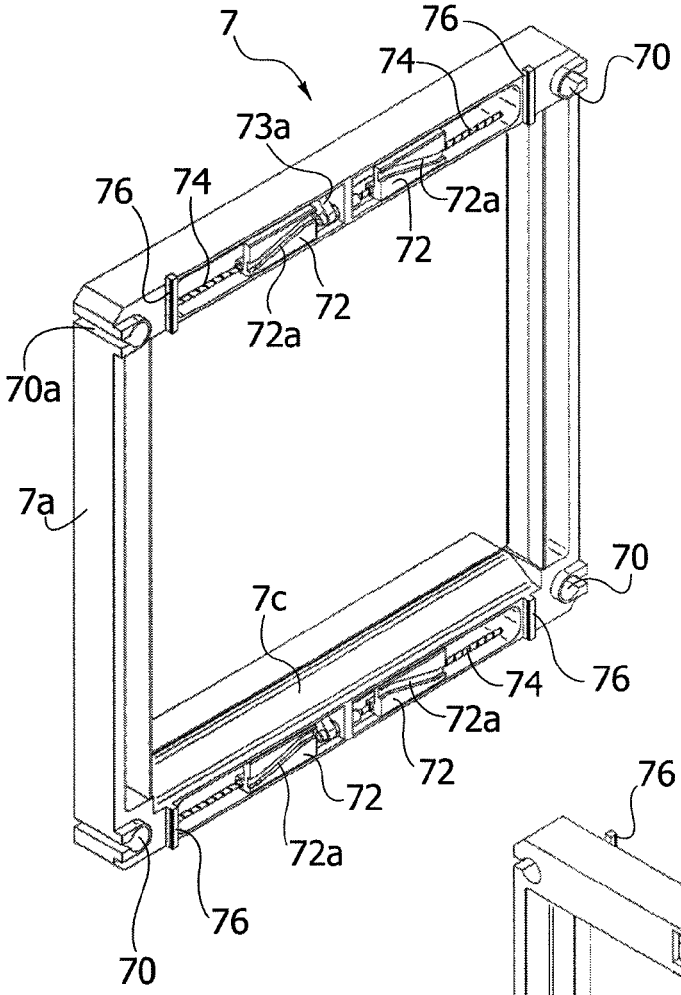
FIGS. 11, 12 are a front perspective view and a rear perspective view of only the second frame that is part of the unit according to the invention.
Figure 12:
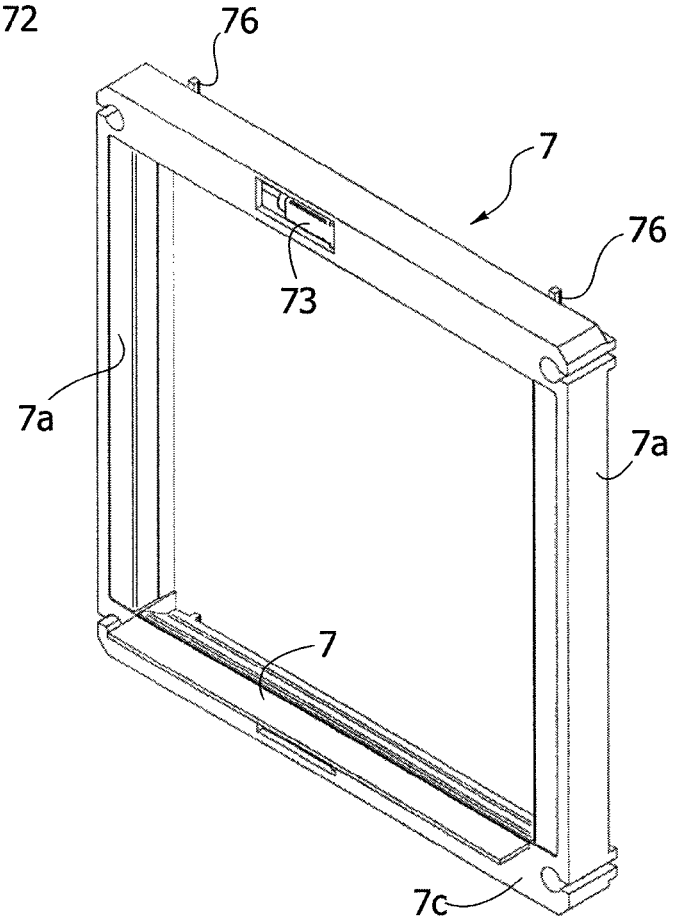
Figure 13:
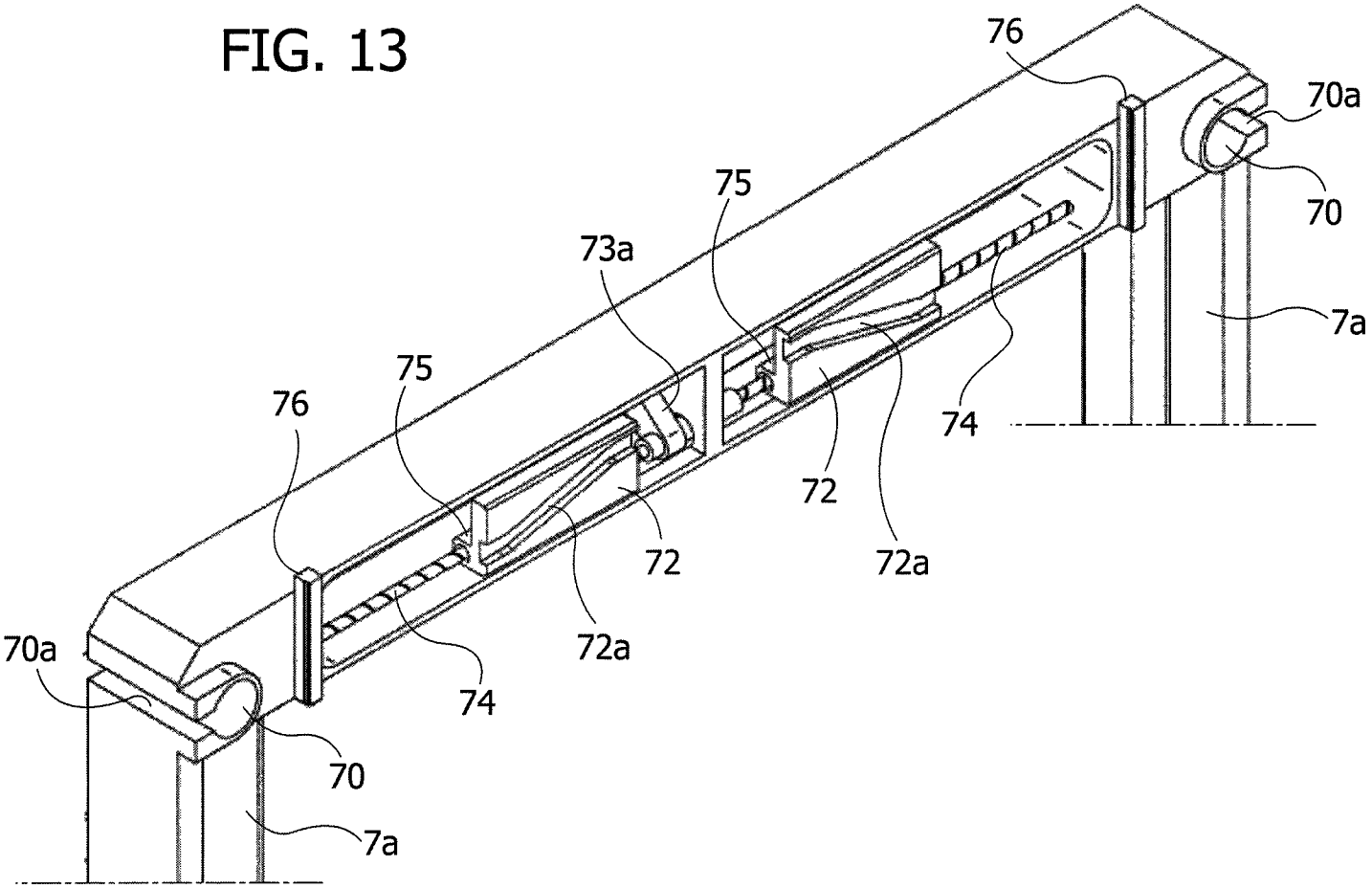
FIG. 13 illustrates FIG. 11 in particular, on an enlarged scale.

FIGS. 11, 12 illustrate an example of an embodiment of the second perimeter frame 7. This second perimeter frame has two vertical uprights 7*a* joined by an upper cross-member 7*b* and a lower cross-member 7*c*. At the four corners of frame 7 seats 70 are present, designed to receive nuts 71, with form coupling, (one of which is visible in FIG. 9), engaged on the screws controlled by the motors 61, associated with the first frame 6. As shown in FIG. 9, in the embodiment shown, each nut 71 has a radial lug nut 71*a* which engages in a corresponding groove 70*a* of the respective seat 70 in the second frame 7 to prevent rotation of the nut 71. With reference still to FIGS. 11, 12 and also to FIG. 13, each of the cross-members 7*b*, 7*c* supports two slides 72 in such a way that they slide horizontally and which move in synchronism between a position reciprocally close to each other and a position distanced from each other to control the vertical movement of the third frame 8 relative to the second frame 7.

The slides 72 have cam tracks 72*a* that are engaged by corresponding cam follower pins 82 (see FIG. 14) provided on the rear face of the third frame 8. The cams 72*a* are shaped in such a way whereby when the slides 72 are carried from their close-range position to their reciprocally distanced position, the pins 82 carried by the third frame 8 are raised, causing a consequent lifting of the entire third frame 8. Conversely, when the two slides 72 approach each other, the third frame 8 is guided from its raised position to its lowered position.

The translation movement of each pair of guides 72 is controlled by a respective electric motor 73 (FIG. 12) that rotationally controls, through a gear box 73*a*, a screw shaft, including two portions 74 with threads oriented in the opposite direction which are engaged by nuts 75 (FIG. 13) associated to the slides 72.

Cross-members 7*b*, 7*c* of the second frame 7 are also provided with vertical guiding profiles 76 at their ends which guide the vertical movement of the third frame 8, by sliding engagement on them of sliding blocks 86 (FIG. 14) carried by the third frame 8.

Figure 14:
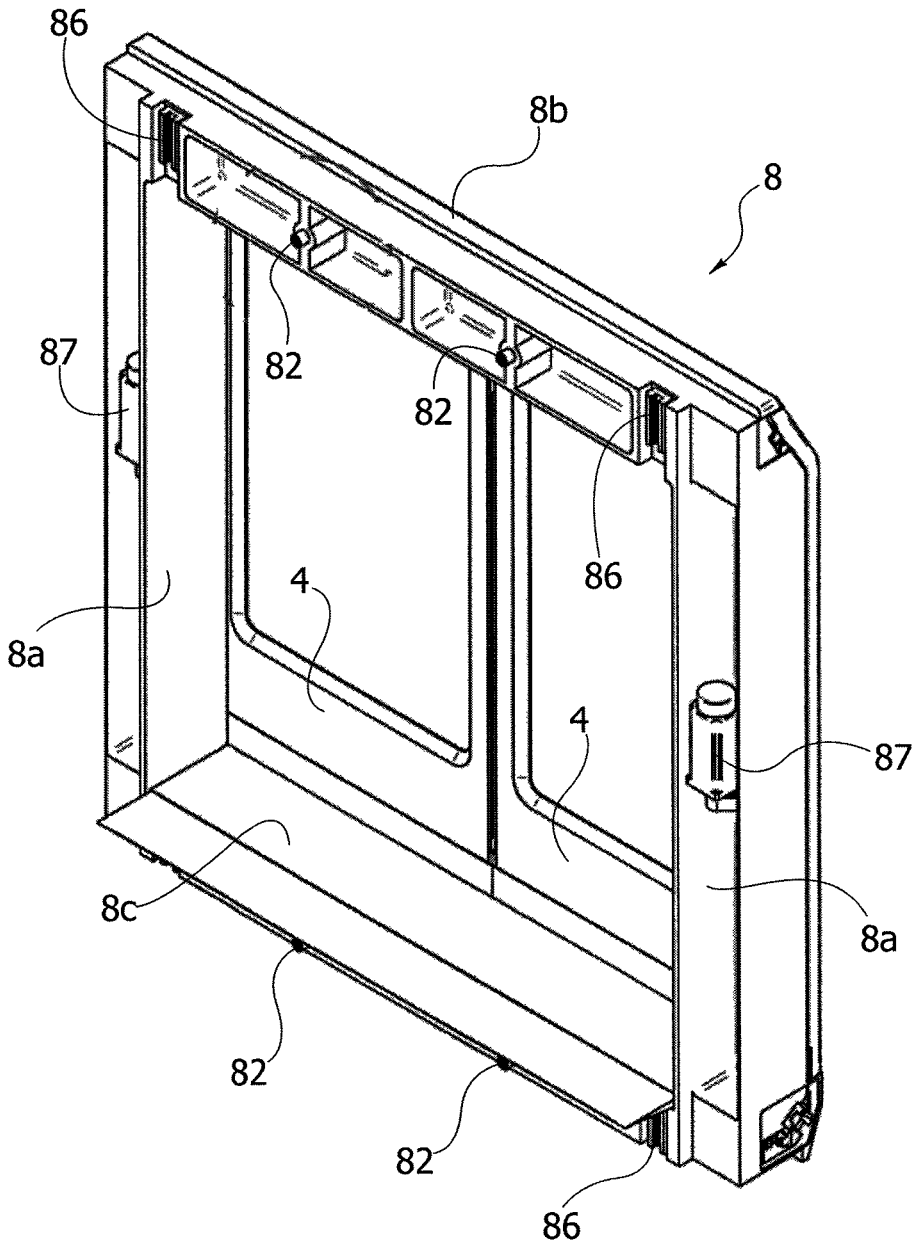
FIG. 14 is a rear perspective view of only the third frame that is part of the unit according to the invention, with the doors mounted onto it and in the closed condition.

With reference to FIG. 14, the third perimeter frame 8 also comprises a structure with two uprights 8*a*, and an upper cross-member 8*b* and a lower cross-member 8*c* connected to each other by the uprights.

The two doors 4 are slidably mounted on the third perimeter frame 8 between their closed position (shown in FIG. 14), and their open position.

Guiding of the sliding movement of the doors 4 is obtained by arrangement of a sliding guide both at the top, and on the bottom of each door. Therefore, each door 4 is guided according to a rectilinear trajectory both at its upper end, and at its lower end, to the advantage of precision guiding and safety of the connection between doors and vehicle.

In the example shown, on the inner side of the upper part of each door 4 a guiding profiled bar 40 is mounted (see in particular FIGS. 16, 19), slidably engaged within a sliding block 80 carried by the third frame 8.

Figure 17:
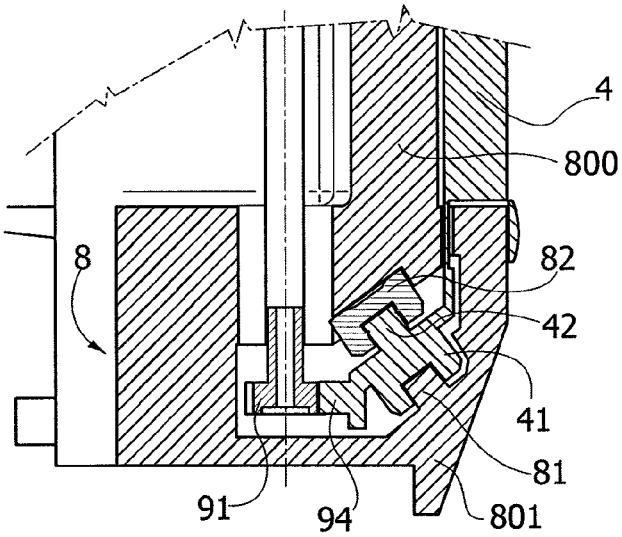
Figure 18:
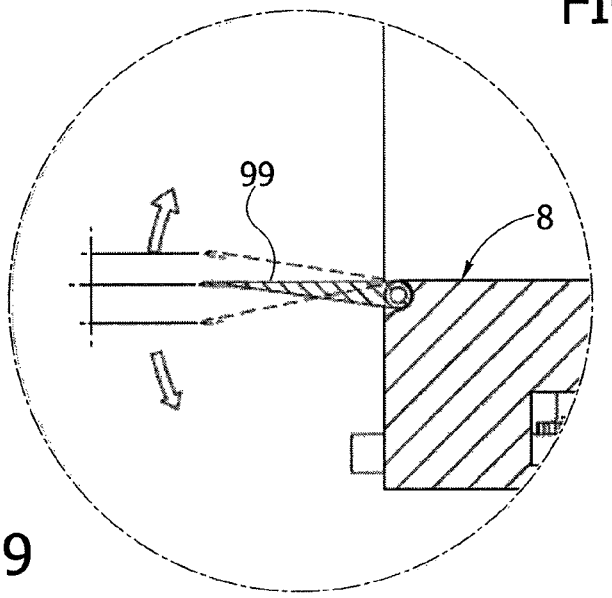
FIG. 18 illustrates a further detail of FIG. 15 on an enlarged scale.
Figure 19:
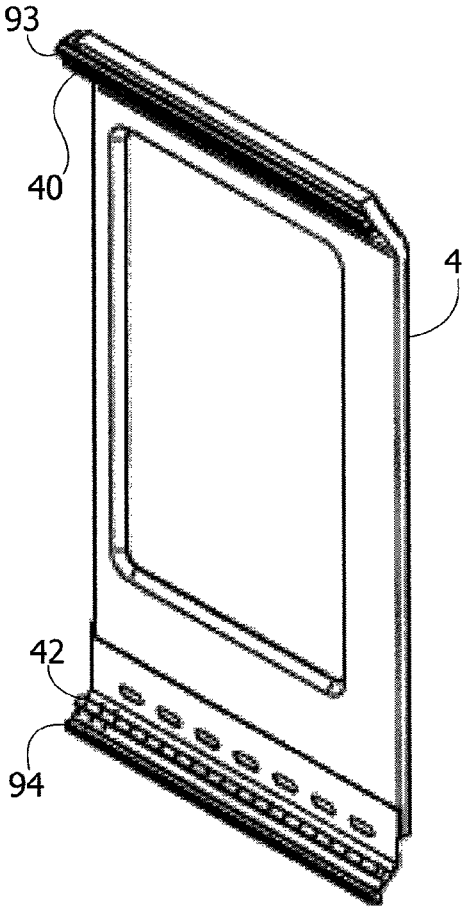
FIGS. 19, 20 are a rear perspective view and a front perspective view of a door that is part of the unit according to the invention.
Figure 20:
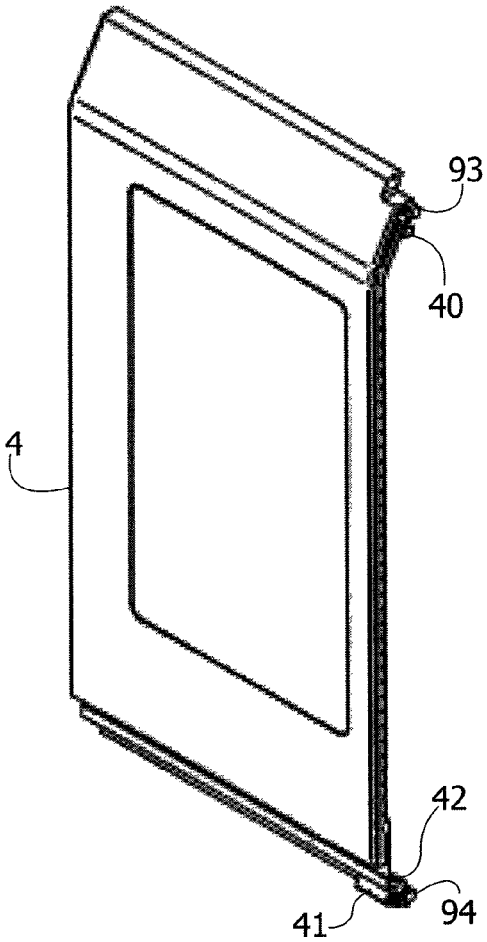
Figure 21:
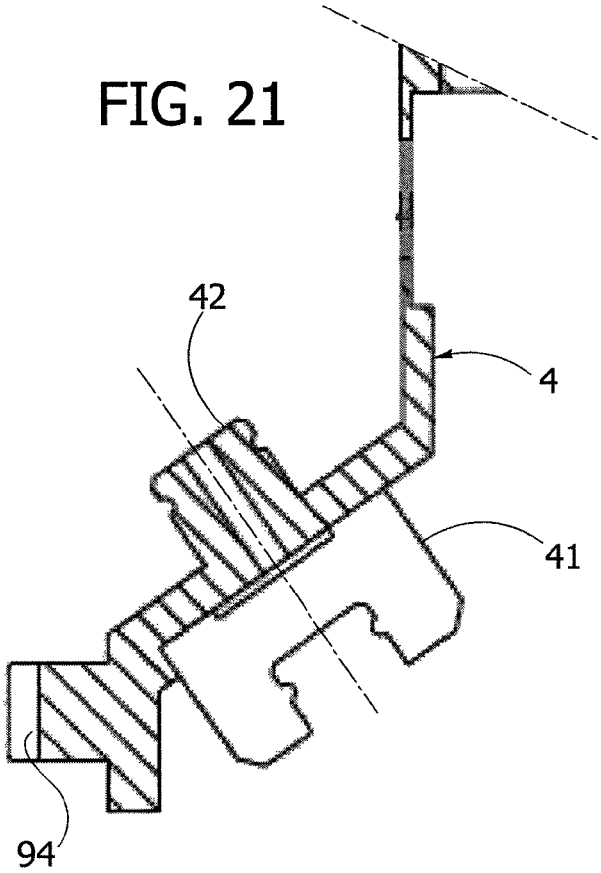
FIGS. 21, 22 are a sectional view and a perspective view, both on an enlarged scale, of two details of the door structure of FIGS. 19, 20, FIGS. 23, 24 are, respectively, a cross-sectional view of the unit according to the invention in the condition wherein the second frame and the third frame are in the rest position, and in the condition wherein the second frame is in the advanced position and the third frame is in the raised position.
Figure 22:
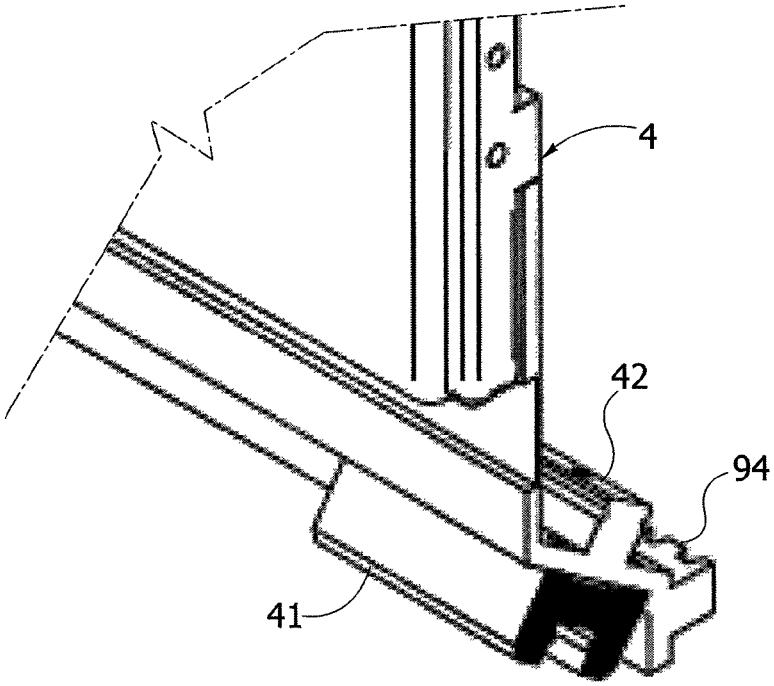

As clearly shown in FIG. 17, in the case of the example of the embodiment illustrated, the lower cross-member of the third frame 8 has a portion 800 that is placed within the lower edge of the door 4 and a portion 801 which projects in a cantilever fashion, and extends upwards to the front of portion 800, in such a way whereby a passage is defined between portions 800 and 801 of frame 8 wherein the lower part of the door 4 is received. On the outer side of the lower part of each door 4 a sliding block 41 is mounted (see in particular FIGS. 17 and 20-22) which engages a guiding profiled bar or rail 81 arranged on the inner side of the portion 801 of frame 8. A profiled bar or rail 42 is also mounted on the inner side of the lower part of the door 4 which slidably engages a sliding block 82, carried by the portion 800 of frame 8.

Therefore, in the case of the example of the embodiment illustrated here, the sliding guide of the lower part of each door 4 is made with two rectilinear guides which are parallel and spaced apart and includes a first guide including a rail carried by the perimeter frame, and a sliding block carried by the door and slidable on the rail, and a second guide that comprises a rail carried by the door, and at least one sliding block carried by the perimeter frame and slidable on the rail. The sliding blocks 80, 82 and 41 are preferably of the ball screw type.

Figure 14A:
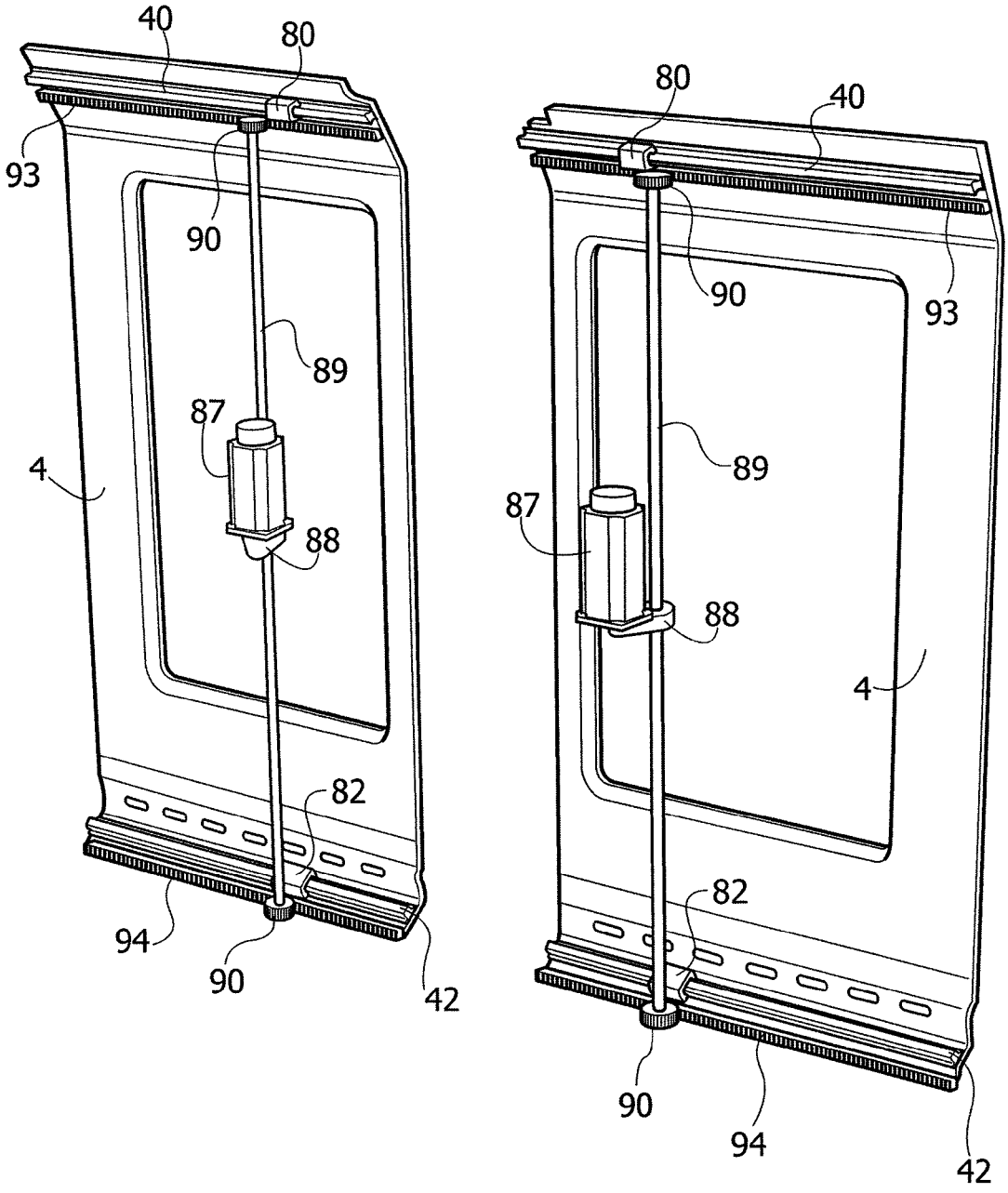
FIG. 14A is a schematic perspective view illustrating only the two sliding doors in the open position and the control transmission of their movement between the open condition and closed condition.
Figure 15:
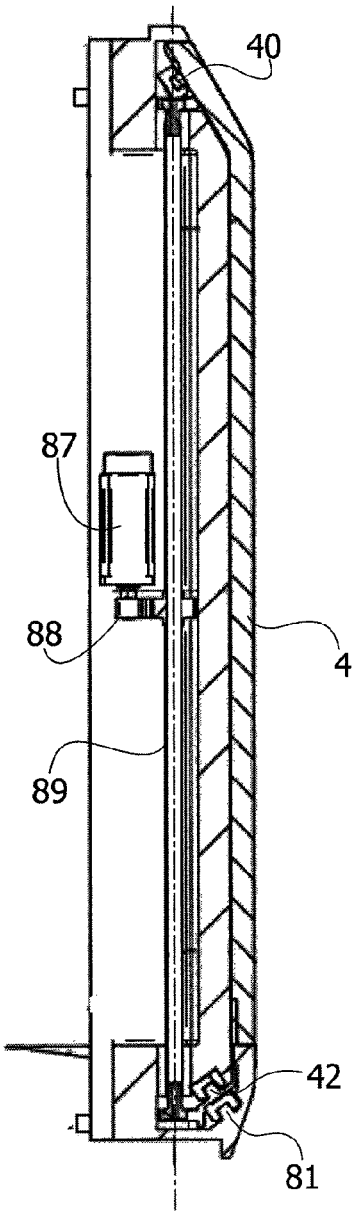
FIG. 15 is a cross-sectional view of the third frame of the unit according to the invention, with the doors mounted on it and the control transmission of the movement of the doors.
Figure 16:
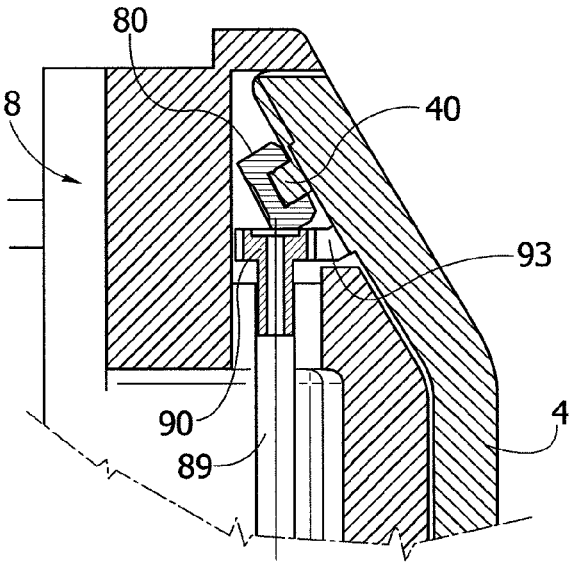
FIGS. 16, 17 illustrate two details of FIG. 15 on an enlarged scale.

Still with reference to FIGS. 14*a*, 16, 17, the movement of the two doors 4 between an open position and a closed position is controlled by two respective electric motors 87 (see also FIG. 14) carried by frame 8, which control a vertical shaft 89 by means of a transmission gear 88, of which upper and lower ends carry two pinions 90, 91 meshing with racks 93 and 94 arranged horizontally at the upper end and lower end of each door 4, on their inner side.

Figure 23:
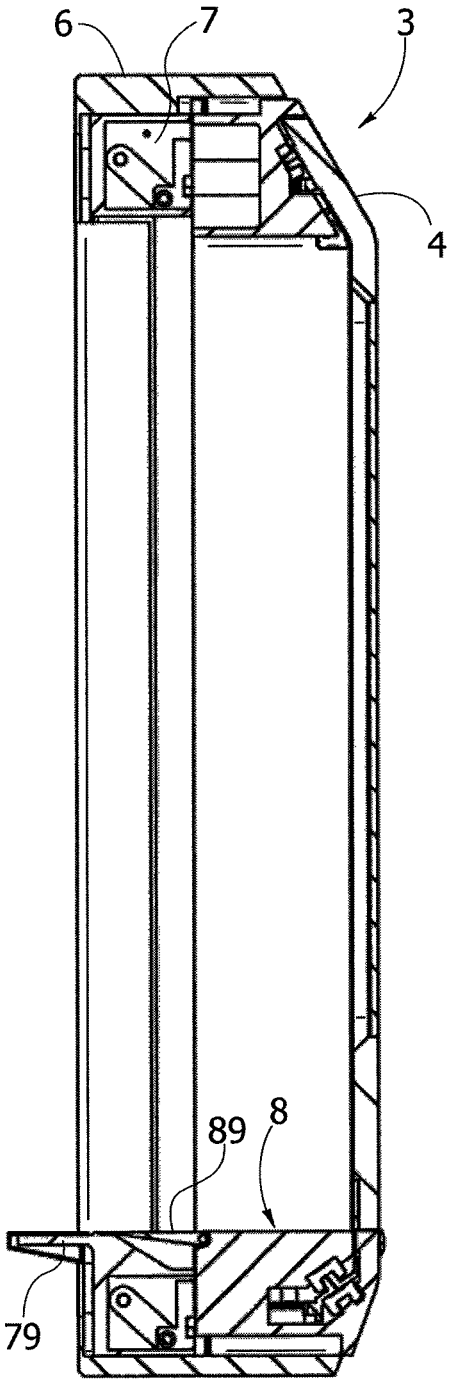
Figure 24:
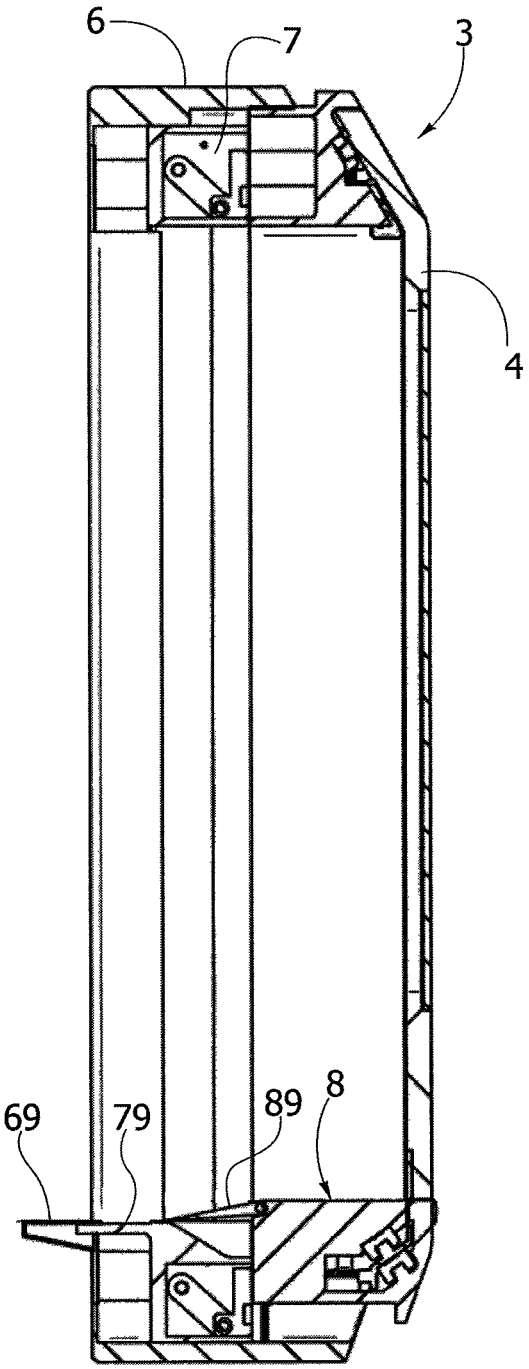
Figure 25:
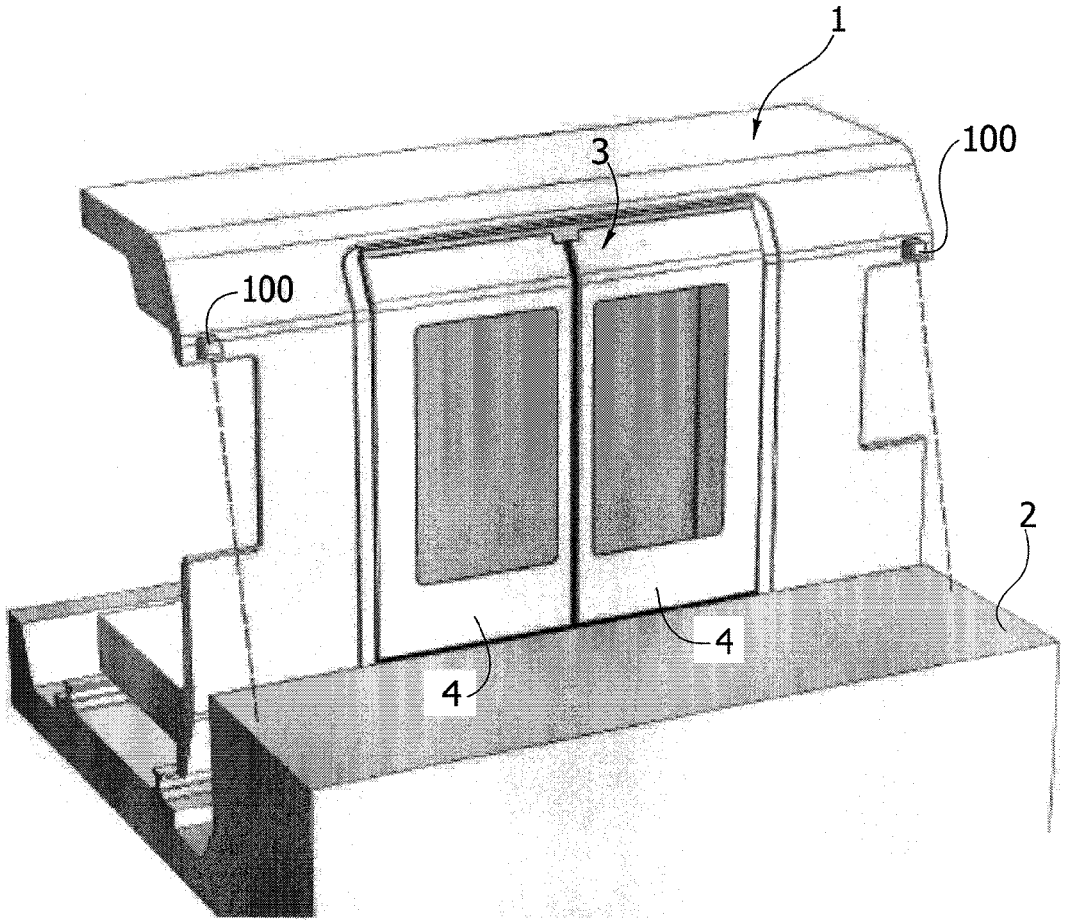
FIG. 25 is a further partial perspective view of the carriage.

FIGS. 23, 24 show the door unit in the closed door condition (with frame 7 in the refracted position and frame 8 in the lowered position), and in the open door condition (with frame 8 in the raised position and frame 7 in the forward position), respectively.

As can be seen, frame 6 and frame 7 present two longitudinal appendices 69, 79 on the upper surface of their lower cross-members that are arranged one inside the other as shown in FIG. 23, and are distanced from each other, to create a continuous standing surface in the advanced condition of frame 7. Similarly, the lower cross-member of the third frame 8 has a longitudinal oscillating whisker 99 which ensures the continuity of the standing surface despite the difference in level that is created in the raised position of frame 8 (see FIG. 24).

The embodiment described above is the most complex, with three perimeter frames 6, 7, 8, supported in succession from one another, frame 6 being fixed, frame 7 being horizontally movable and frame 8 being vertically movable.

In a simpler embodiment (not shown in the drawings), the door unit only includes the fixed frame 6 rigidly connected to the vehicle and frame 7 movable horizontally, while frame 8 and the means for controlling its vertical movement are absent. Obviously in this case it is frame 7 which carries the doors 4 and the guiding and controlling means of the door (entirely the same as those described above with reference to frame 8 in the more complex embodiment). In the case of this embodiment, the door unit is able to compensate for the horizontal gap between the vehicle floor and the platform, but not the vertical gap.

The invention also includes the variant wherein the unit only includes the fixed frame 6 rigidly connected to the vehicle and the vertically movable frame 8, that, in this case, is directly supported by the fixed frame 6 and carries the doors, in a manner analogous to that illustrated above. In this case frame 7 is not provided, and consequently nor are the means for controlling its horizontal movement. In the case of this embodiment, the door unit is able to compensate for the vertical gap between the vehicle floor and the platform, but not the horizontal gap.

Nevertheless a further simplified embodiment (not shown in the drawings) is also considered by the invention that provides a single perimeter frame 6 rigidly connected to the vehicle and directly supporting the doors 4. In this case it is the same frame 6 which carries the means for supporting and guiding the doors, as well as related control means, which can be entirely analogous to those described above with reference to frame 8. Naturally, in the case of this further simplified embodiment, the door unit is not able to compensate for any gap between the vehicle floor and the station platform, but still has the advantage of the basis of the invention, that is, to provide a door module that is able to be completely assembled and adjusted prior to installation on the vehicle, without the need for any adjustment operation after installation. As repeatedly stated, this advantage is achieved by the fact that the unit comprises at least one perimeter frame defining the doorway, and carrying the supporting, guiding and controlling means of the doors and for the fact that in the closed condition, the doors only cooperate with parts of the perimeter frame of the unit in order to achieve tight closure of the compartment door. Again in the case of this simplified embodiment, there is also the preferred characteristic to provide at least one sliding guide of the door on the door unit both for the upper part of the door and for the lower part of the door.

In addition, whatever the embodiment of choice (with one, two or three frames) it is preferable to adopt two sliding guides of the door, parallel and spaced between each other, for the lower part of the door (as described above with reference to frame 8 of the more complex embodiment) and/or for the upper part of the door including, respectively, a first guide which includes a rail carried by the perimeter frame, and at least one sliding block carried by the door and slidable on the rail, and a second guide that includes a rail carried by the door, and at least one sliding block carried by the perimeter frame and slidable on the rail.

Preferably, the lower cross-member of frame 8 carries, on its outer surface, at least one pair of proximity sensor devices 100 (FIG. 3) of any known type suitable for reporting the position of the vertical surface of the platform which the door unit faces, to an electronic control unit, when the vehicle stops at a station. This is so as to allow the activation of an alarm signal in case the detected gap is greater than a predetermined value, or, according to an embodiment variant, the automatic activation of the drive motors of the horizontal movement of frame 7. In addition there are additional proximity sensors devices 100 provided, of any known type, placed in an elevated position on the side of the vehicle, at the two sides of the door (FIG. 25) and acting to signal the position of the horizontal surface of the platform to the electronic control unit, so as to allow the activation of an alarm signal in case the detected gap is greater than a predetermined value, or, according to an embodiment variant, the automatic activation of the drive motors of the vertical movement of frame 8 to obtain the correct placement of the doors immediately adjacent to the edge of the platform and at the same level. Of course, the sensors are also applicable to the variant with a single perimeter frame (in order to obtain the generation of an alarm signal) or to the variant with only two perimeter frames.

Preferably, the invention comprises a sub-system detection of obstacles placed in the path of the closing doors. Also preferably provided are analysis means of the vertical form of the vehicle defined by the coach and carriage as a whole and for preventive signaling for the need for maintenance.

FIGS. 26-30 show a further embodiment of the invention, which relates to a door unit for a high-speed train, comprising a single sliding door. In these Figures the common parts to those of FIGS. 1-25 are indicated with the same reference number. In this case, unit 3 only includes two perimeter frames: a fixed frame 6 and a horizontally movable frame 7 which is also the frame which carries the supporting, guiding and controlling means, guide of the sliding door.

Figure 26:
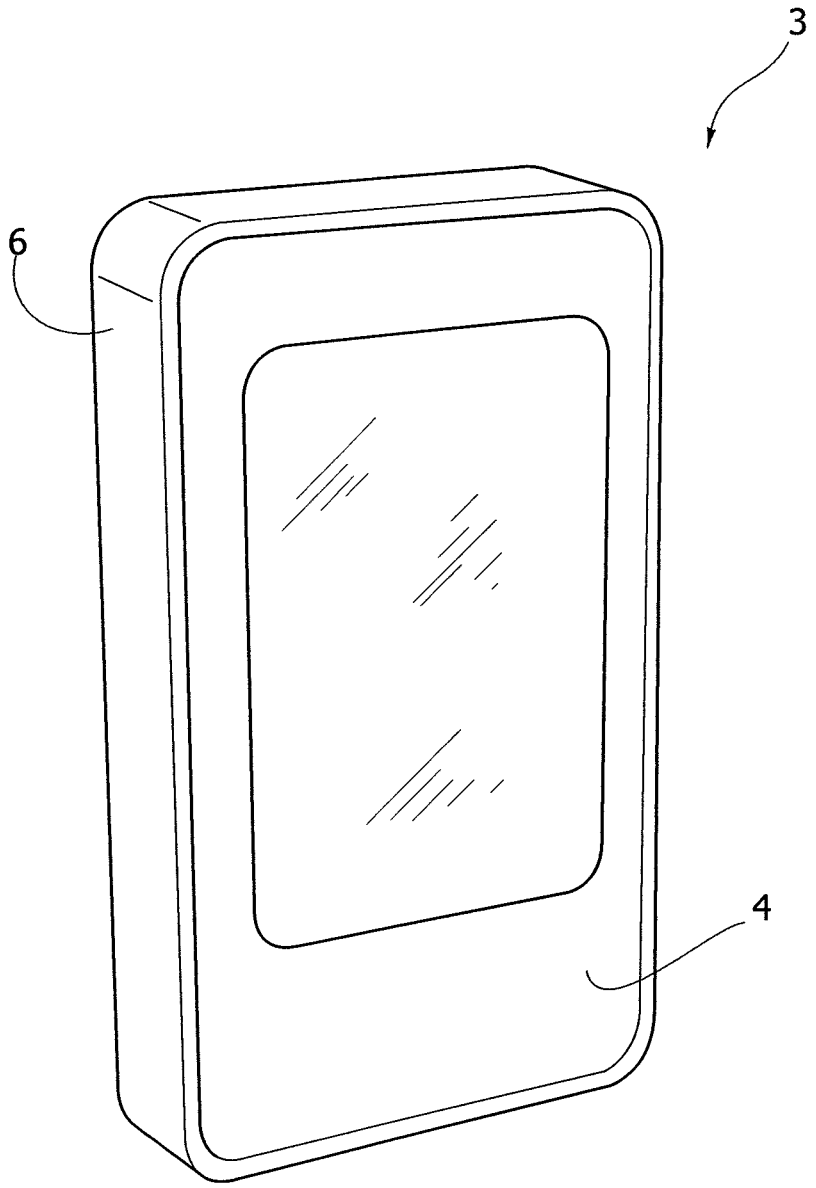
FIG. 26 is a perspective view of a second embodiment, which relates to a door unit for a high-speed train, comprising a single sliding door.
Figure 27:
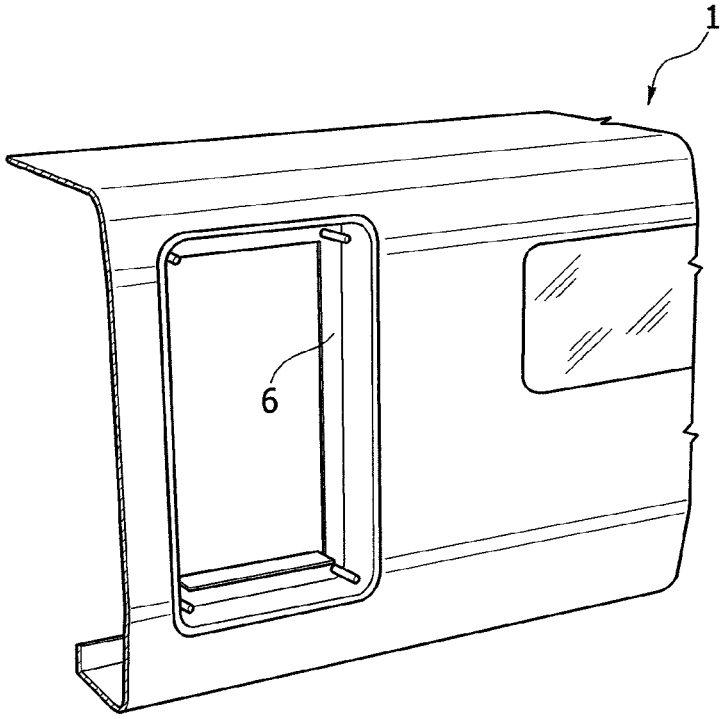
FIG. 27 is a partial perspective view and partially sectioned view of a train carriage incorporating the fixed perimeter frame that is part of the unit of FIG. 26.
Figure 28:
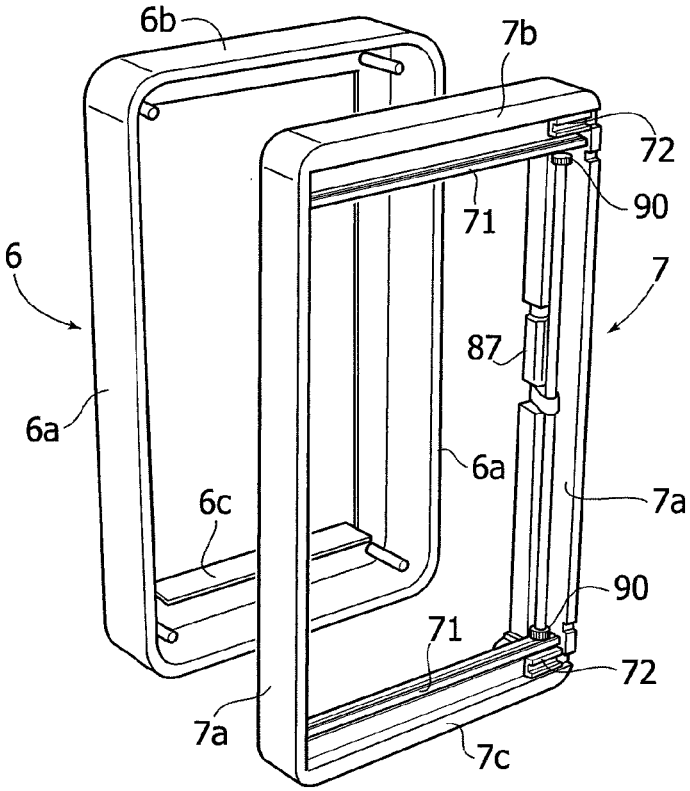
FIG. 28 is an exploded perspective view of the fixed perimeter frame and the horizontally movable perimeter frame carried by the fixed frame.
Figure 29:
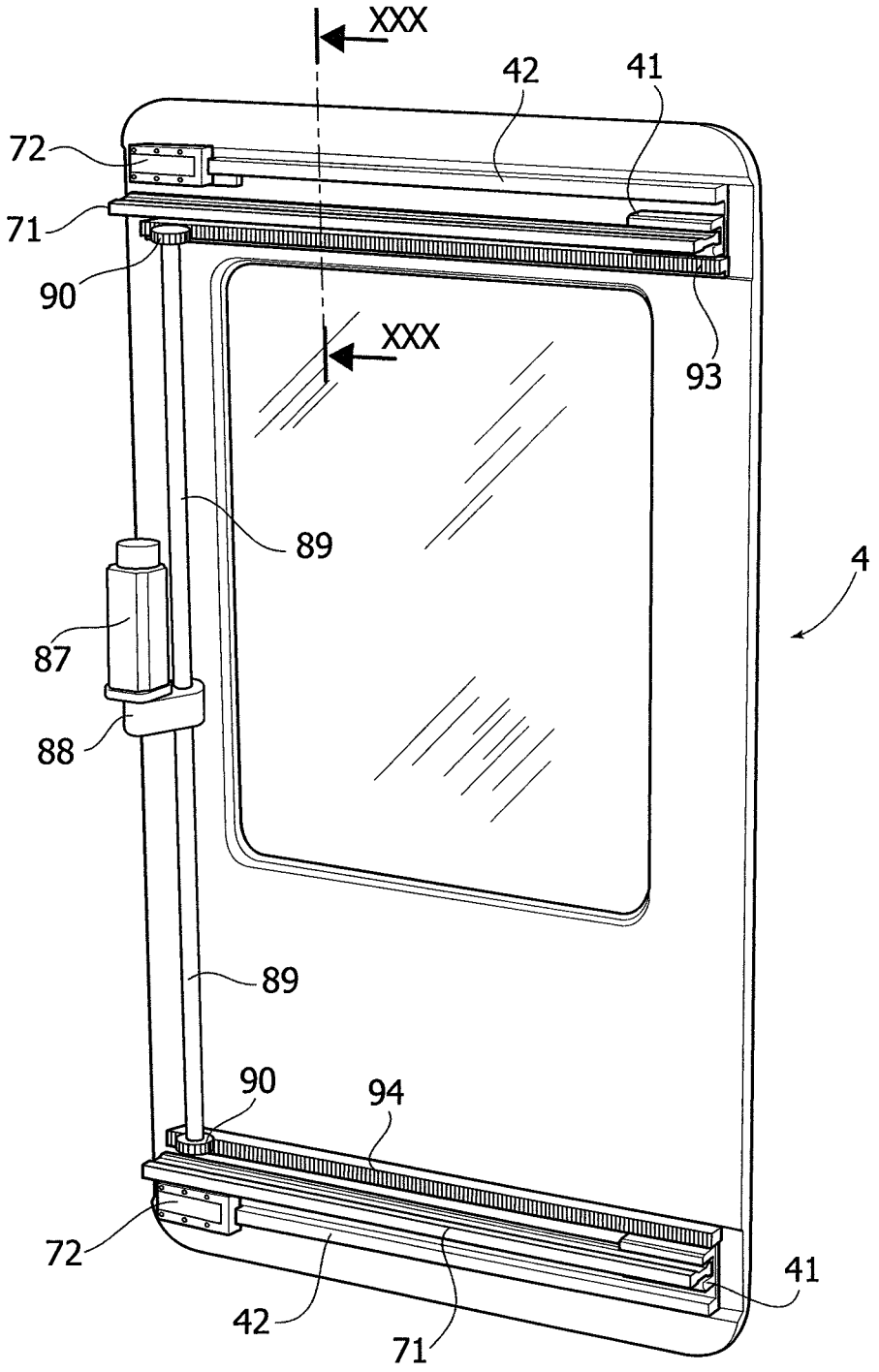
FIG. 29 is a perspective view showing the inner side of the door of the unit of FIGS. 26-28.
Figure 30:
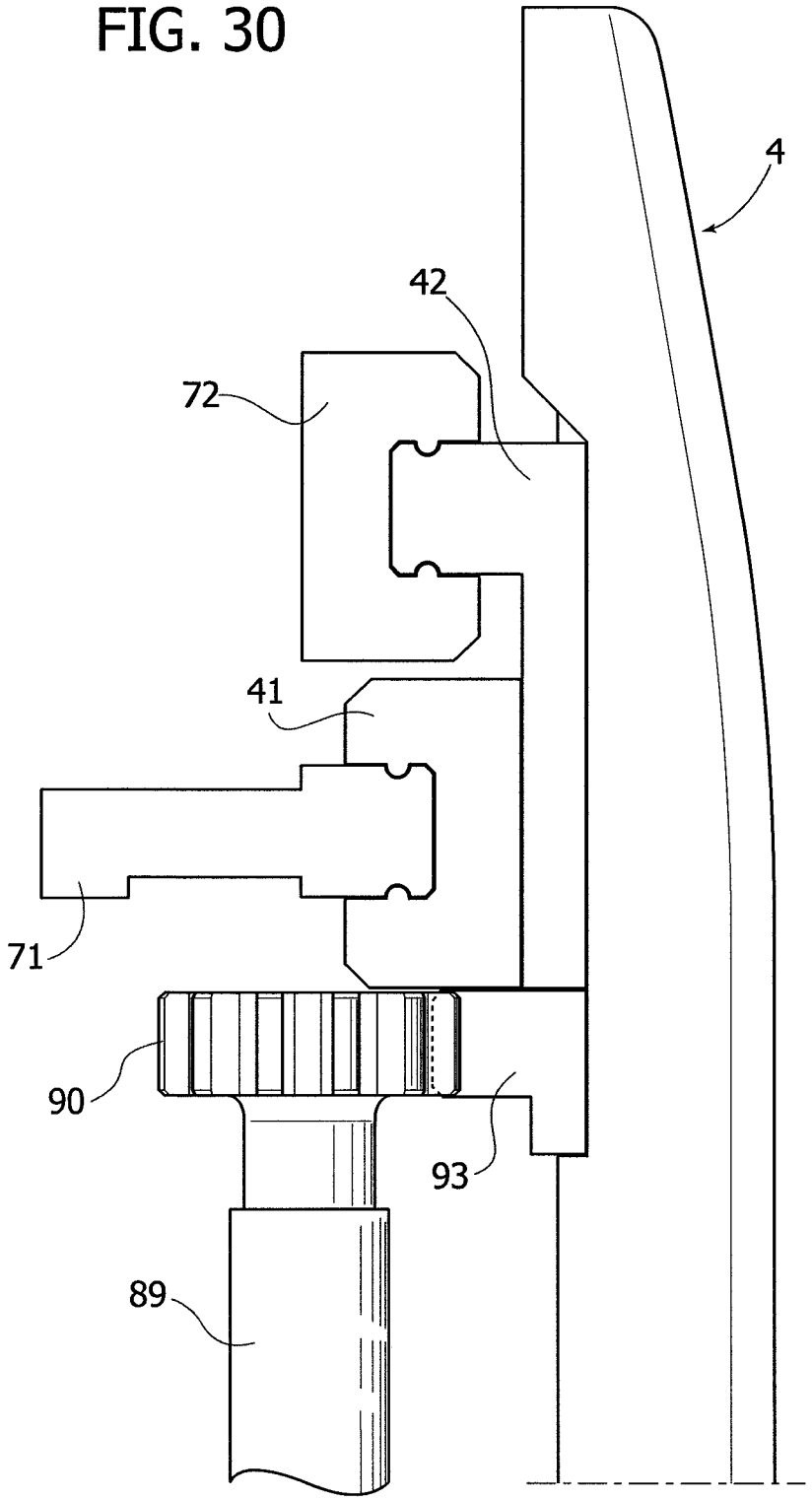
FIG. 30 is a sectional view, on an enlarged scale, along the line XXX-XXX of FIG. 29.

FIG. 26 shows unit 3 as a whole, while FIG. 27 only shows the fixed perimeter frame 6 rigidly mounted in a seat provided in the side of the carriage of a train. FIG. 28 shows an exploded view of the fixed frame 6 and the movable frame 7 carrying the guides for the upper and lower part of the door. With reference to FIGS. 28-30, in this case two parallel and vertically spaced guides are provided, both for the upper part of the door, and for the lower part. On the inner side of the upper part of the door 4, a sliding block 41 is mounted, slidable on a rail 71 carried by frame 7. Above the sliding block 71, on the inner side of the upper part of the door 4, a rail 42 is also mounted on which a sliding block 72 slides, carried by frame 7. Analogously, on the inner side of the lower part of the door 4, a sliding block 41 is mounted, which slides on a rail 71 of frame 7, as well as a rail 42 on which a sliding block 72 of frame 7 slides. Analogously to the embodiment already described, the door 4 carries upper rack 93 and lower rack 94 on its inner side with which two pinions 90 mesh, carried at opposite ends of two vertical shafts, driven by the gear motor unit 87, 88 carried by frame 7.

Naturally, for this second embodiment it is also possible to consider that the door is carried and guided by a third vertically movable frame with respect to frame 7. It is not precluded, even in this case, an embodiment without movable frames, with a single fixed perimeter frame that supports and guides the sliding door. Also in this case, there is still the advantage deriving from the fact that in the closed condition the door only cooperates with the frame to achieve tight closure of the compartment door, for which the unit according to the invention is able to be assembled and controlled separately and then be quickly installed on the vehicle, without the need for further adjustment operations.

The predisposition of the double linear guide described above both for the upper part of the door and for the lower part of the door ensures the precision of the door movement and the consequent possibility to guarantee its correct movement, once the unit is installed on the vehicle. Moreover, the connection between the door and the vehicle results in being more secure and is able to completely avoid the risk of detachment of the door even in the case of high stresses, such as in the case of a depression effect outside the vehicle when it passes another high-speed vehicle in a tunnel.

Finally, even in this further embodiment, sensor devices are of course provided and signaling and/or automatic adaptive control means, which have been described for the first embodiment.

Of course, without prejudice to the principle of the invention, the details of construction and the embodiments may widely vary with respect to those described and illustrated purely by way of example, without departing from the scope of the present invention.

For example, in the illustrated embodiment the means for controlling the movement of the perimeter frames are independent of each other, so that these frames are able to simultaneously move in the respective directions of movement. This makes it possible to significantly reduce the total time of door opening, which can be a particularly important condition in the case of a subway train. The ability to associate two or more frames to common means of control, capable of causing the successive movement of the frames is not, however, ruled out.

The invention claimed is:

1. Door unit for rail vehicles, comprising:

at least one sliding door, means for supporting and guiding said at least one sliding door between a closed position and an open position, means for controlling the movement of said at least one door between a closed position and an open position, wherein said means for supporting and guiding, and said controlling means are carried on a support unit which defines an independent module with said at least one door, assembled before being mounted on the structure of the vehicle, at least one frame connectable to the vehicle structure and carrying said at least one door, and respective guiding and controlling means, said at least one frame comprising an upper cross-member, a lower cross-member and two uprights connecting these cross-members between them, so as to form a perimeter frame that defines a doorway and which surrounds the four sides of said at least one door when it is in a closed position, said at least one frame comprising:

a first perimeter frame, rigidly connectable to the vehicle structure, and a second perimeter frame supporting said means for supporting and guiding said at least one door and said controlling means of said at least one door, the second perimeter frame being supported by said first frame so as to be displaceable with respect to it in a horizontal direction orthogonal to the general plane of the door, between a retracted position and an advanced position with respect to the side of the vehicle, in order to reduce or eliminate any gap in the horizontal direction between the vehicle floor and the station platform, actuating means carried by said first frame, to control the horizontal movement of said second frame with respect to said first frame between the retracted position and the advanced position, and in said closed position said at least one door only cooperating with parts of said at least one perimeter frame to achieve the closure of the compartment door.

2. Door unit according to claim 1, wherein said means for guiding of the movement of said at least one door, carried by said support unit comprise at least one upper sliding guide which guides the upper part of said at least one door on said upper cross-member of said perimeter frame, and at least one lower sliding guide which guides the lower part of said at least one door on said lower cross-member of said perimeter frame.

3. Door unit according to claim 1, wherein the upper and the lower parts of said at least one door are each provided with two sliding guides which are parallel and spaced, including, respectively, a first guide which comprises a rail carried by the perimeter frame, and at least one sliding block carried by the door and slidable on the rail, and a second guide that includes a rail carried by the door, and at least one sliding block carried by the perimeter frame and slidable on the rail.

4. Door unit according to claim 1, wherein said at least one frame includes a single perimeter frame, rigidly connectable to the vehicle structure and carrying said means for supporting and guiding said at least one door and said controlling means of said at least one door.

5. A door unit according to claim 1, wherein said at least one frame comprises:

a first perimeter frame, rigidly connectable to the structure of the vehicle, and a second perimeter frame supported by said first frame so as to be displaceable with respect to it in a horizontal direction orthogonal to the general plane of the door, between a retracted position and an advanced position with respect to the side of the vehicle, in order to reduce or eliminate any gap in the horizontal direction between the vehicle floor and the station platform, said unit further comprising:

actuator means carried by said first frame, to control the horizontal movement of said second frame with respect to said first frame between the retracted position and the advanced position, and a third frame, carrying said means for supporting and guiding said at least one door and said controlling means of said at least one door, said third frame being supported by said second frame and being displaceable with respect to it in a vertical direction, in order to reduce or eliminate any difference in height between the vehicle floor and the station platform, and actuator means carried by said second frame, for controlling the vertical movement of said third frame with respect to said second frame.

6. A door unit according to claim 5, wherein said means for controlling the movement of said at least one door carried by said third frame include:

a motor, a vertical shaft rotationally driven by the motor, and a pair of pinions mounted on opposite ends of said vertical shaft and meshing with rack arranged along the upper portion and the lower portion of said at least one door.

7. Door unit according to claim 5, wherein said second frame carries actuator means for controlling the vertical movement of the third frame, including:

a motor, a screw shaft directed in a horizontal direction parallel to the longitudinal direction of the vehicle, rotationally driven by the motor and having two portions with threads of opposite direction, and two slides associated with nuts within which are engaged said threaded portions for controlling a synchronous movement of said slides towards or away from each other, said slides having cam tracks engaged by cam follower elements carried by said third frame in such a way as to cause a vertical movement of said third frame between a raised position and a lowered position as a result of the movement of said slides between their mutually close-range position and their mutually distanced position.

8. A door unit according to claim 5, wherein the actuator means carried by the first frame for controlling the horizontal movement of the second frame comprise at least one motor carried by the first frame, which rotationally controls a direct screw in a horizontal direction and transverse to the longitudinal direction of the vehicle and engaged in a nut which is associated with the second frame.

9. A door unit according to claim 5, wherein said support unit is provided with sensor means for detecting the distance of the door unit from a station platform when the vehicle is stationary at the station and electronic control means adapted to receive output signals from said sensor means and generate an alarm signal when the distance detected is not contained within a predetermined range, or to control the actuator means which control the horizontal movement of the second frame, and actuator means which control the vertical movement of the third frame in order to automatically reduce or eliminate the gap in the horizontal direction and the gap in the vertical direction between the vehicle floor and the platform when the vehicle is stationary at the station, so as to provide an automatic adaptation of the door unit to the actual distance from the station platform.

10. A door unit according to claim 1, further comprising a detection sub-system of obstacles placed in the path of closing doors.

11. A door unit according to claim 1, further comprising analysis means of the vertical form of the vehicle, defined by the coach and carriage as a whole, and for preventive signaling for the need for maintenance.

12. A door unit according to claim 1, wherein at least one door comprises a single sliding door.

13. A door unit according to claim 1, wherein said at least one door comprises a pair of sliding doors between a mutually close-range closed position and a mutually distanced open position, each door being provided with said means for supporting and guiding and said means of control.

14. A door unit according to claim 1, wherein the means of controlling the movement of said perimeter frames are independent of each other, whereby these frames are able to simultaneously move in their respective directions of movement.

* * * * *